US009704682B2

(12) United States Patent
Hirose et al.

(10) Patent No.: US 9,704,682 B2
(45) Date of Patent: Jul. 11, 2017

(54) OPERATION INDICATING LAMP-EQUIPPED ELECTROMAGNETIC RELAY

(71) Applicant: OMRON Corporation, Kyoto-shi, Kyoto (JP)

(72) Inventors: Yuji Hirose, Kyoto (JP); Masayuki Shinohara, Kyoto (JP); Hiroyuki Miyamoto, Shiga (JP); Yasuhiro Tanoue, Shiga (JP)

(73) Assignee: OMRON Corporation, Kyoto (JP)

( * ) Notice: Subject to any disclaimer, the term of this patent is extended or adjusted under 35 U.S.C. 154(b) by 0 days.

(21) Appl. No.: 14/737,606

(22) Filed: Jun. 12, 2015

(65) Prior Publication Data

US 2015/0364283 A1 Dec. 17, 2015

(30) Foreign Application Priority Data

Jun. 13, 2014 (JP) ..... 2014-122356

(51) Int. Cl.
*H01H 9/02* (2006.01)
*H01H 50/08* (2006.01)

(52) U.S. Cl.
CPC ..... *H01H 50/08* (2013.01)

(58) Field of Classification Search
CPC ..... H01H 50/08; H01H 51/22; H01H 73/12; H01H 73/14
USPC ..... 335/202
See application file for complete search history.

(56) References Cited

U.S. PATENT DOCUMENTS 5,081,436 A * 1/1992 Nishi ..... H01H 50/021 335/131
6,498,552 B1 * 12/2002 Lozano Rico ..... H01H 50/021 335/124
6,856,220 B2 * 2/2005 Saruwatari ..... H01H 50/326 335/17

(Continued)

FOREIGN PATENT DOCUMENTS

GB 2105454 A 3/1983
JP S54183658 U 12/1979

(Continued)

OTHER PUBLICATIONS

Extended European Search Report issued in corresponding European Application No. 15167883.6, mailed on Feb. 17, 2016 (10 pages).

*Primary Examiner* — Shawki S Ismail
*Assistant Examiner* — Lisa Homza
(74) *Attorney, Agent, or Firm* — Osha Liang LLP

(57) ABSTRACT

An operation indicating lamp-equipped electromagnetic relay has an excitation coil, a contract member that has electromagnetic interaction with the excitation coil to open and close a circuit, a housing in which the excitation coil and the contact member are disposed, and having a display surface arranged in a top surface thereof, a light source having an optical axis that is oriented toward a direction other than the display surface in order to display an operating situation of the electromagnetic relay, and being disposed in the housing so as to emit light according to a situation of power supplied to the excitation coil, a reflecting member disposed in the housing so as to reflect the light emitted from the light source toward the display surface, and a diffusion structure that diffuses the light reflected by the reflecting member formed in the display surface.

12 Claims, 19 Drawing Sheets

(56) References Cited

U.S. PATENT DOCUMENTS

| | | | | |
|---|---|---|---|---|
| 6,911,884 | B2 * | 6/2005 | Uotome | H01H 47/06 335/132 |
| 6,914,503 | B2 * | 7/2005 | Saruwatari | H01H 50/08 335/17 |
| 6,924,719 | B2 * | 8/2005 | Saruwatari | H01H 50/08 335/17 |
| 7,676,426 | B2 * | 3/2010 | Lawrence | G06Q 20/10 705/38 |
| 7,859,371 | B2 * | 12/2010 | Takano | H01H 50/26 335/128 |
| 9,406,468 | B2 * | 8/2016 | Osumi | H01H 50/06 |
| 2008/0224878 | A1 * | 9/2008 | Takada | H01H 50/08 340/644 |
| 2010/0195019 | A1 * | 8/2010 | Shinohara | G02B 6/0016 349/62 |
| 2015/0015351 | A1 * | 1/2015 | Osumi | H01H 50/06 335/202 |
| 2015/0043192 | A1 * | 2/2015 | Tanoue | H01H 9/161 362/23.03 |
| 2015/0114810 | A1 * | 4/2015 | Tanoue | H01H 9/161 200/314 |
| 2015/0234109 | A1 * | 8/2015 | Hirose | G02B 5/0226 362/558 |

FOREIGN PATENT DOCUMENTS

| | | | |
|---|---|---|---|
| JP | H08-184713 | A | 7/1996 |
| JP | 4319973 | B2 | 8/2009 |

* cited by examiner

| Surface Roughness(μm) | Haze (%) | Visual Quality |
|---|---|---|
| 4 | 47.8 | ○ |
| 5 | 15.2 | × |
| 5 | 44.7 | ○ |
| 6.5 | 20.0 | × |
| 9.5 | 46.3 | ○ |
| 9.5 | 24.9 | × |
| 10 | 65.3 | ○ |
| 16.5 | 50.9 | ○ |
| 23 | 76.8 | ○ |
| 25 | 86.5 | ○ |
| 26 | 66.2 | ○ |
| 28 | 78.4 | ○ |
| 33 | 72.9 | ○ |
| 47 | 83.6 | ○ |
| 67 | 88.1 | ○ |
| 73 | 88.4 | × |

*FIG. 30*

OPERATION INDICATING LAMP-EQUIPPED ELECTROMAGNETIC RELAY

CROSS-REFERENCE TO RELATED APPLICATION

This application claims foreign priority to Japanese Patent Application No. 2014-122356 filed with the Japan Patent Office on Jun. 13, 2014, the entire contents of which are incorporated herein by reference.

BACKGROUND

Field

The present invention relates to an electromagnetic relay (relay). Specifically, the present invention relates to a relay having a function of displaying a light emitting operation.

Related Art

In some conventional relays, an operation indicating lamp is provided in the relay in order that a worker easily checks an operation of the relay. The operation indicating lamp is lit or turned off in conjunction with opening and closing operations of the relay. Generally, in order to facilitate visual recognition of a lighting state of the operation indicating lamp from the outside, there is a demand for easily seeing light of the operation indicating lamp on an opposite side to a bottom surface that is of a relay attaching surface, namely, on a side of a case top surface. For this purpose, it is conceivable that the operation indicating lamp is vertically arranged in a case with respect to the case top surface. At the same time, there is also demand for the compact relay. Therefore, a space in the case in which the operation indicating lamp is arranged is restricted, and the operation indicating lamp is horizontally arranged to make the compact relay in the case that there is no space in the case in which the operation indicating lamp is arranged.

For example, in a relay disclosed in Japanese Patent No. 4319973, a light guide path that extends vertically along a side surface of a case (housing) is provided outside the case. The top surface of the light guide path is located at the same level as the top surface of the case, and constitutes a display surface of the light guide path. The light horizontally emitted from a light source (lighting unit) horizontally provided in the case is input to the light guide path from a lower end portion of the light guide path, reflected toward the case top surface by a reflecting surface, guided in the light guide path, and output from the display surface that is of the top surface of the light guide path. As a result, when the light source is lit, the display surface of the light guide path glows on the top surface of the relay.

In a relay disclosed in Unexamined Japanese Utility Patent Publication No. S54 (1979)-183658, the light guide path (light output body) is provided in the relay, the light source faces a lower end face of the light guide path, and a lens is provided in an upper end face of the light guide path.

SUMMARY

However, in the relay disclosed in Japanese Patent No. 4319973, the light output from the display surface has poor uniformity, and the light output from the display surface has narrow directivity angle. For this reason, even if the display surface glows while the light source is lit, visibility degrades when the relay is observed in an oblique direction (a direction oblique to a direction perpendicular to the top surface of the relay). Particularly, in the case that many relays are attached to a control panel, it is necessary to observe the individual relay in the direction perpendicular to the top surface and to move a head portion sequentially along an array of the relays in order to check the lighting state of the relay, which results in a troublesome work.

In the relay disclosed in Japanese Patent No. 4319973, a diffused reflection surface is provided around the display surface by roughening the top surface of the case. The diffused reflection surface improves the visibility of the display surface by scattering the light leaking from the surroundings of the display surface. The diffused reflection surface is provided at a position deviating from an optical path of the light output from the display surface, and little light leaks from the side surface of the light guide path. Therefore, the diffused reflection surface is of a degree to which the state of the display surface can be highlighted when the display surface is viewed from a front. In the diffused reflection surface, it is difficult to clearly recognize the lighting state of the light source when the light source is viewed in the oblique direction.

The lens disclosed in Unexamined Japanese Utility Patent Publication No. 54(1979)-183658 is not a diffusing lens but a collecting lens. Accordingly, even in the relay disclosed in Unexamined Japanese Utility Patent Publication No. 54(1979)-183658, the lighting state of the light source can easily be recognized in the direction perpendicular to the top surface, while the lighting state of the light source can hardly be recognized in the oblique direction.

One or more embodiments of the present invention provides a compact operation-indicating-lamp-equipped electromagnetic relay in which the lighting of the light source (operation indicating lamp) can easily visually be recognized even in the oblique direction.

According to one or more embodiments of the present invention, an operation indicating lamp-equipped electromagnetic relay configured to open and close a circuit by electromagnetic interaction between an excitation coil and a contact member, the operation indicating lamp-equipped electromagnetic relay includes: a housing configured to accommodate the excitation coil and the contact member therein; a light source including an optical axis that is oriented toward a direction other than a display surface arranged in a top surface of the housing in order to display an operating situation of the electromagnetic relay, the light source being accommodated in the housing so as to emit light according to a situation of power supplied to the excitation coil; and a reflecting member accommodated in the housing so as to reflect the light emitted from the light source toward the display surface. At this point, a diffusion structure configured to diffuse the light reflected by the reflecting member is formed in the display surface.

The reflecting member reflects the light emitted from the light source toward the display surface arranged on the top surface of the housing. The light reflected by the reflecting member is diffused by the diffusion structure formed on the display surface. Therefore, the uniformity and directionality of the light output from the display surface can further be improved. Accordingly, the visibility is improved when the housing of the electromagnetic relay is observed from obliquely above. As a result, the compact operation-indicating-lamp-equipped electromagnetic relay in which the lighting of the light source is easily visually recognized even in the oblique direction can be provided.

In the operation indicating lamp-equipped electromagnetic relay according to one or more embodiments of the present invention, the reflecting member reflects the light emitted from the light source to propagate in air.

According to the configuration, by a simple combination of the reflecting member and the diffusion structure, the visibility can be enhanced when the housing of the electromagnetic relay is observed from obliquely above.

An operation indicating lamp-equipped electromagnetic relay according to one or more embodiments of the present invention further includes a light guide unit configured to guide the light reflected by the reflecting member to the display surface. At this point, the reflecting member reflects the light emitted from the light source to propagate in air, and the light guide unit includes a side surface configured to totally reflect the reflected light to guide the totally-reflected light to the display surface.

According to the configuration, the light reflected by the reflecting member is totally reflected by the side surface of the light guide unit, and guided to the display surface. As a result, an outline of the display surface is clearly viewed when the housing of the electromagnetic relay is observed from obliquely above.

An operation indicating lamp-equipped electromagnetic relay according to one or more embodiments of the present invention further includes a light guide unit configured to guide the light reflected by the reflecting member to the display surface. At this point, the reflecting member is integrated with the light guide unit, and the reflecting member includes a total reflection surface arranged so as to totally reflect the light emitted from the light source to guide the totally-reflected light to the display surface.

According to the configuration, the light totally reflected by the total reflection surface of the reflecting member is totally reflected by the side surface of the light guide unit, and guided to the display surface. As a result, an outline of the display surface is clearly viewed when the housing of the electromagnetic relay is observed from obliquely above.

In the operation indicating lamp-equipped electromagnetic relay according to one or more embodiments of the present invention, the reflecting member reflects the light emitted from the light source to propagate in air, and a diffuse reflection structure configured to diffusely reflect the light is formed in the reflecting member, the light being emitted from the light source to propagate in air.

According to the configuration, the diffuse reflection structure is formed in the reflecting member while the diffusion structure is formed in the display surface, so that the uniformity and directionality of the light output from the display surface can further be improved.

An operation indicating lamp-equipped electromagnetic relay according to one or more embodiments of the present invention further includes a light guide unit configured to guide the light reflected by the reflecting member to the display surface. At this point, a diffuse reflection structure configured to diffusely reflect the light is formed in the reflecting member, the light being emitted from the light source to propagate in air.

According to the configuration, the diffuse reflection structure is formed in the reflecting member while the diffusion structure is formed in the display surface, so that the uniformity and directionality of the light output from the display surface can further be improved.

An operation indicating lamp-equipped electromagnetic relay according to one or more embodiments of the present invention further includes a light guide unit configured to guide the light reflected by the reflecting member to the display surface. At this point, a diffuse reflection structure configured to diffusely reflect the light is formed in the reflecting member, the light being emitted from the light source to propagate in air, the reflecting member is integrated with the light guide unit, the reflecting member includes a total reflection surface arranged so as to totally reflect the light emitted from the light source to guide the totally-reflected light to the display surface, and the diffuse reflection structure is formed in the total reflection surface.

According to the configuration, the diffuse reflection structure is formed in the total reflection surface of the reflecting member while the diffusion structure is formed in the display surface, so that the uniformity and directionality of the light output from the display surface can further be improved.

An operation indicating lamp-equipped electromagnetic relay according to one or more embodiments of the present invention further includes a holder accommodated in the housing so as to hold the light emitting diode and the reflecting member. At this point, the light source is a light emitting diode, the holder holds the light emitting diode such that an optical axis of the light emitting diode is oriented toward the direction other than the display surface, and the holder is formed so as to cover a top surface side of the light emitting diode.

According to the configuration, the light emitting diode is arranged in the direction parallel to the display surface by the simple configuration, so that the compact electromagnetic relay can be made. Because the holder shields the light that is directly oriented from the light emitting diode toward the display surface, the light is output only from the region of the display surface. Accordingly, only the shape of the display surface that outputs the light can visually be recognized.

According to one or more embodiments of the present invention, an operation indicating lamp-equipped electromagnetic relay configured to open and close a circuit by electromagnetic interaction between an excitation coil and a contact member, the operation indicating lamp-equipped electromagnetic relay includes: a housing configured to accommodate the excitation coil and the contact member therein; a light source including an optical axis that is oriented toward a direction other than a display surface arranged in a top surface of the housing in order to display an operating situation of the electromagnetic relay, the light source being accommodated in the housing so as to emit light according to a situation of power supplied to the excitation coil; and a reflecting member accommodated in the housing so as to reflect the light emitted from the light source toward the display surface. At this point, a diffuse reflection structure configured to diffusely reflect the light emitted from the light source is formed in the reflecting member.

The light emitted from the light source is diffusely reflected by the diffuse reflection structure formed in the reflecting member, and guided to the display surface. Therefore, the uniformity and directionality of the light output from the display surface can further be improved. Accordingly, the visibility is improved when the housing of the electromagnetic relay is observed from obliquely above. As a result, the compact operation-indicating-lamp-equipped electromagnetic relay in which the lighting of the light source is easily visually recognized even in the oblique direction can be provided.

In an operation indicating lamp-equipped electromagnetic relay according to one or more embodiments of the present invention, the diffuse reflection structure diffusely reflects the light, emitted from the light source to propagate in air, to guide the diffusely-reflected light to the display surface.

According to the configuration, by a simple combination in which the diffuse reflection structure is formed in the reflecting member, the visibility can be enhanced when the housing of the electromagnetic relay is observed from obliquely above.

An operation indicating lamp-equipped electromagnetic relay according to one or more embodiments of the present invention further includes a light guide unit configured to guide the light diffusely reflected by the diffuse reflection structure to the display surface. At this point, the light guide unit includes a side surface configured to totally reflect the diffusely-reflected light to guide the totally-reflected light to the display surface.

According to the configuration, the light diffusely reflected by the diffuse reflection structure formed in the reflecting member is totally reflected by the side surface of the light guide unit, and guided to the display surface. As a result, an outline of the display surface is clearly viewed when the housing of the electromagnetic relay is observed from obliquely above.

An operation indicating lamp-equipped electromagnetic relay according to one or more embodiments of the present invention further includes a light guide unit configured to guide the light diffusely reflected by the diffuse reflection structure to the display surface. At this point, the reflecting member is integrated with the light guide unit, the reflecting member includes a total reflection surface arranged so as to totally reflect the light emitted from the light source to guide the totally-reflected light to the display surface, and the diffuse reflection structure is formed in the total reflection surface.

According to the configuration, the light diffusely reflected by the diffuse reflection structure formed in the total reflection surface of the reflecting member is further totally reflected by the side surface of the light guide unit, and guided to the display surface. As a result, an outline of the display surface is clearly viewed when the housing of the electromagnetic relay is observed from obliquely above.

The diffusion structure that diffuses the light reflected by the reflecting member is formed in the display surface, so that one or more embodiments of the present invention provides a compact operation-indicating-lamp-equipped electromagnetic relay in which the lighting of the light source can easily visually be recognized even in the oblique direction.

BRIEF DESCRIPTION OF THE DRAWINGS

FIG. 30 is a view illustrating a relationship among surface roughness of a diffusion structure formed in the top output unit of the operation indicators of the first to fourth embodiments, a haze value, and visual quality;

DETAILED DESCRIPTION

Hereinafter, exemplary embodiments of the present invention will be described in detail. In embodiments of the invention, numerous specific details are set forth in order to provide a more thorough understanding of the invention. However, it will be apparent to one of ordinary skill in the art that the invention may be practiced without these specific details. In other instances, well-known features have not been described in detail to avoid obscuring the invention.

First Embodiment

Figure 1A:
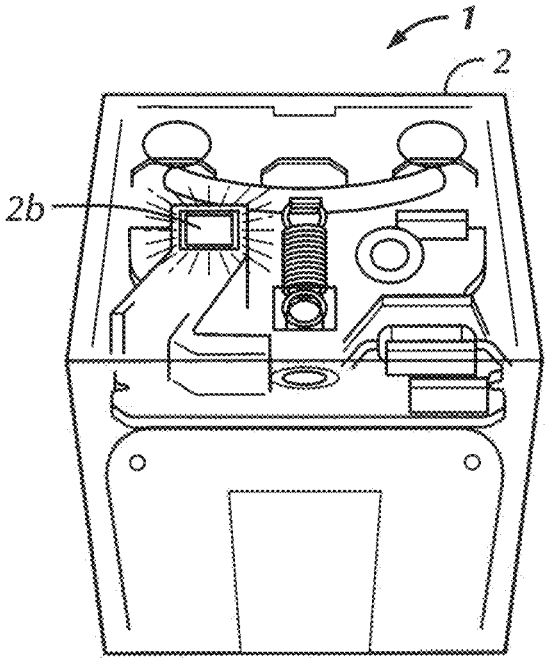
FIG. 1A is an image in a relay according to a first embodiment is viewed from obliquely above.
Figure 1B:
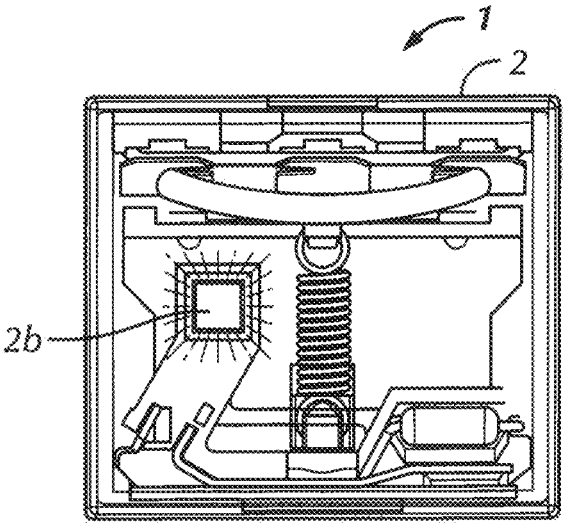
FIG. 1B is an image in which the relay is viewed from above.
Figure 2A:
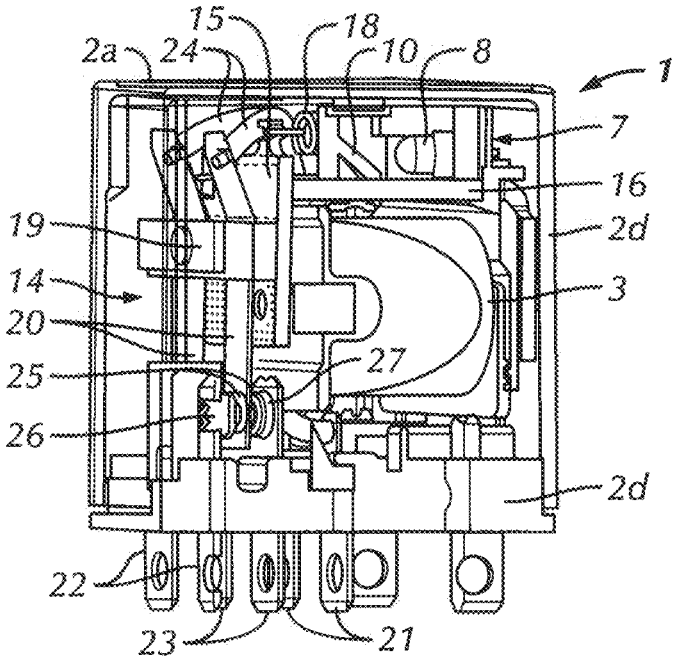
FIG. 2A is a perspective sectional view of the relay of the first embodiment.
Figure 2B:
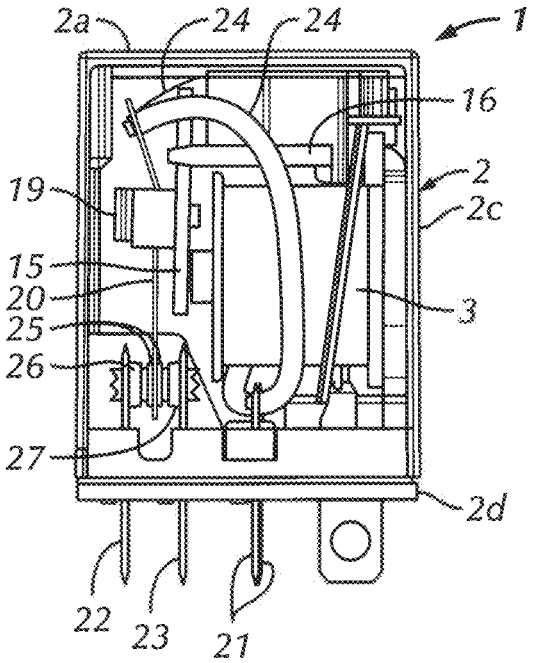
FIG. 2B is a side sectional view of the relay.
Figure 3A:
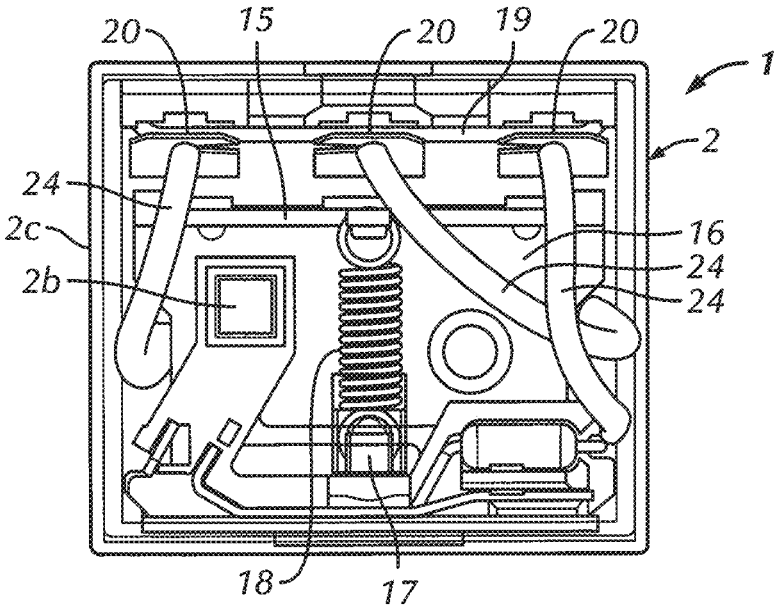
FIG. 3A is a plan view of the relay of the first embodiment.
Figure 3B:
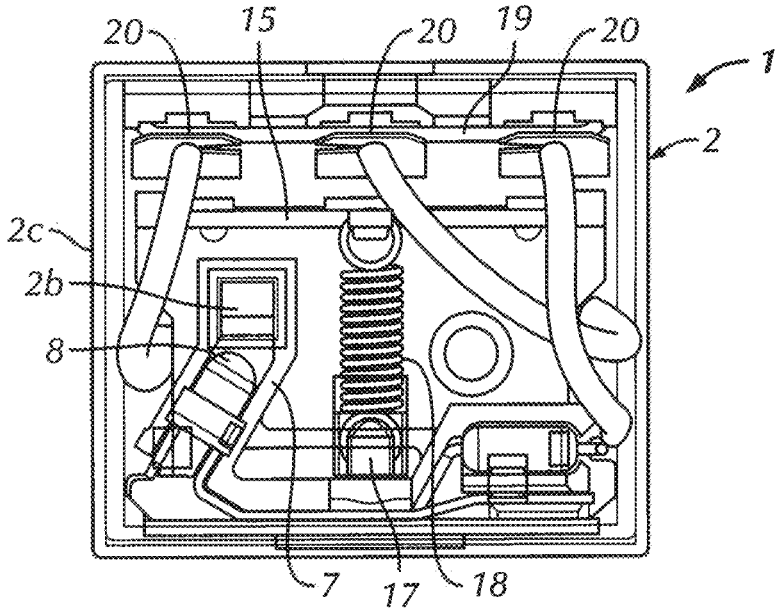
FIG. 3B is a plan view of the relay in which an LED and an LED holder are removed.

FIG. 1A is an image in a relay (electromagnetic relay) 1 according to a first embodiment is viewed from obliquely above, and FIG. 1B is an image in which the relay 1 is viewed from above. FIG. 2A is a perspective sectional view of the relay 1, and FIG. 2B is a side sectional view of the relay 1. FIG. 3A is a plan view of the relay 1, and FIG. 3B is a plan view of the relay 1 in which an operation indicating lamp 8 and an LED holder 7 are removed.

(Configuration of Relay Body 14)

In the relay 1, a relay body 14 and a shell-type operation indicating lamp (light source) 8 constructed with a Light Emitting Diode (LED) are incorporated in a rectangular parallelepiped case (housing) 2. The case 2 is constructed with a base 2*d* made of an opaque resin and a housing 2*c* made of a transparent resin.

The relay body 14 having a structure in FIGS. 2A and 2B is provided on a top surface of the base 2*d*. A coil unit (excitation coil) 3 is fixed to the top surface of the base 2*d*. A lower portion of an armature 15 faces an end face of an iron core of the coil unit 3, and an upper portion of the armature 15 is swingably supported by a yoke 16. One end of a spring 18 (tension spring) is hooked in a spring hook 17 (FIG. 3) provided on the top surface of the yoke 16, and the other end of the spring 18 is hooked at an upper end of the armature 15. Accordingly, the armature 15 is swung back and forth, and the lower portion of the armature 15 is attracted to the iron core to move backward when the coil unit 3 is excited. Because a portion above a supporting point of the armature 15 is elastically pulled backward by the spring 18, and the lower portion of the armature 15 separates from the iron core to move forward when the coil unit 3 is demagnetized.

Plural movable contact springs 20 are attached in parallel to a front surface of the armature 15 by a support 19. Plural common terminals 21, plural normally closed terminals 22, and plural normally opened terminals 23 are inserted in the base 2*d* so as to vertically pierce the base 2*d*. An upper end of each movable contact spring 20 is electrically connected to the corresponding common terminal 21 by a cable line 24. A lower end portion of the movable contact spring 20 is located between an upper end portion of the normally closed terminal 22 and an upper end portion of the normally opened terminal 23, and movable contacts (contact member) 25 are provided on both surfaces of the lower end portion of the movable contact spring 20. A normally closed contact (contact member) 26 is provided in the upper end portion of each normally closed terminal 22 so as to face the movable contact 25 in front of the movable contact 25. A normally opened contact (contact member) 27 is provided in the upper end portion of each normally opened terminal 23 so as to face the movable contact 25 at the back of the movable contact 25.

In the relay body 14, in the case that the coil unit 3 is not excited, because the lower portion of the armature 15 is located in front of the iron core while separating from the iron core, a lower portion of the movable contact spring 20 also moves forward. Therefore, in this state, the movable contact 25 contacts with the normally closed contact 26 to electrically connect the common terminal 21 and the normally closed terminal 22 to each other, and the movable contact 25 separates from the normally opened contact 27 to electrically disconnect the common terminal 21 and the normally opened terminal 23 to each other.

When the coil unit 3 is excited, the lower portion of the armature 15 is attracted to the iron core to move rearward, and the lower portion of the movable contact spring 20 also moves rearward. Therefore, the movable contact 25 contacts with the normally opened contact 27 to electrically connect the common terminal 21 and the normally opened terminal 23 to each other, and the movable contact 25 separates from the normally closed contact 26 to electrically disconnect the common terminal 21 and the normally closed terminal 22 to each other.

The housing 2*c* is a molding project made of a high-refractive-index transparent resin such as a polycarbonate resin. Alternatively, the housing 2*c* may be a molding project made of a semi-transparent resin or a colored transparent resin. In such cases, desirably the semi-transparent resin having a higher transparency and the colored transparent resin having a paler color are used such that an inside of the relay 1 is checked.

(Configuration of LED Holder 7)

Figure 4A:
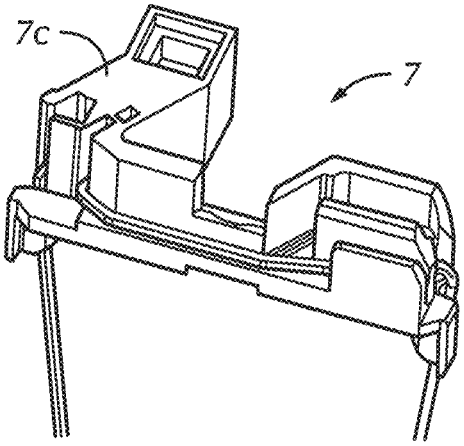
FIG. 4A is a perspective view illustrating an appearance of the LED holder provided in the relay of the first embodiment.
Figure 4B:
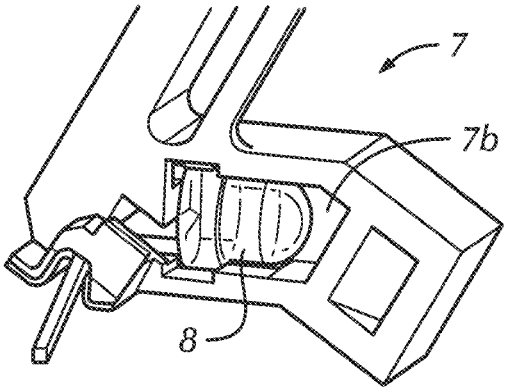
FIG. 4B is a perspective view illustrating a bottom surface of the LED holder.
Figure 4C:
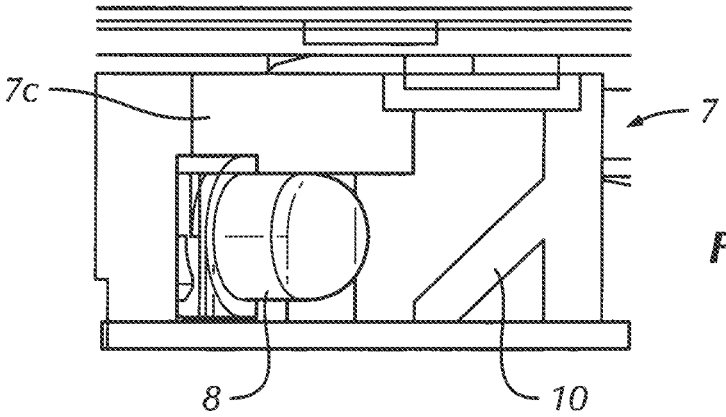
FIG. 4C is a sectional view of the LED holder.

FIG. 4A is a perspective view illustrating an appearance of the LED holder 7 provided in the relay 1, FIG. 4B is a perspective view illustrating a bottom surface of the LED holder 7, and FIG. 4C is a sectional view of the LED holder 7.

The operation indicating lamp 8 is fitted in a recess 7*b* provided in an end portion of the LED holder 7, and held by the LED holder 7. The LED holder 7 is fixed to the top surface of the yoke 16 (FIG. 2A). Therefore, the operation indicating lamp 8 is located in an upper end portion in a space of the case 2. The operation indicating lamp 8 is connected to a wiring portion (not illustrated). The operation indicating lamp 8 is lit or turned off according to an operating state of the relay 1 so as to be able to visually recognize the operating state of the relay 1. For example, the operation indicating lamp 8 is turned off during the non-operating state of the relay 1, namely, when the common terminal 21 and the normally opened terminal 23 are not electrically connected to each other while the common terminal 21 and the normally closed terminal 22 are electrically connected to each other. On the other hand, the operation indicating lamp 8 is lit during the operating state of the relay 1, namely, when the common terminal 21 and the normally opened terminal 23 are electrically connected to each other while the common terminal 21 and the normally closed terminal 22 are not electrically connected to each other.

A light shielding roof 7*c* and a bottom output unit (reflecting member) 10 are provided in the LED holder 7. The light shielding roof 7*c* is formed between a top surface 2*a* of the case 2 and the operation indicating lamp 8 so as to cover the operation indicating lamp 8. The bottom output unit (reflecting member) 10 reflects the light emitted from the operation indicating lamp 8, and guides the light to a square top output unit (display surface) 2*b* arranged on the top surface 2*a* of the case 2. Because the light shielding roof 7*c* is formed in the LED holder 7 as a measure against light leakage from the operation indicating lamp 8, the operation indicating lamp 8 is fitted in the recess 7*b* of the LED holder 7 from below.

(Configuration of Operation Indicator of First Embodiment)

Figure 5:
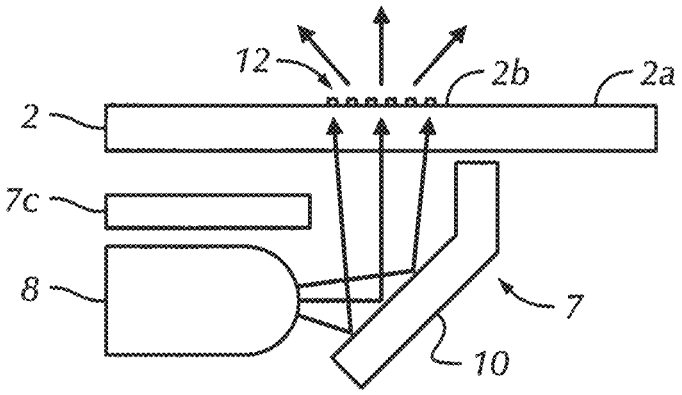
FIG. 5 is a schematic diagram illustrating a configuration of an operation indicator provided in the relay of the first embodiment.

FIG. 5 is a schematic diagram illustrating a configuration of an operation indicator provided in the relay 1. The operation indicator is constructed with the LED holder 7, the operation indicating lamp 8, and a top output unit 2*b*. A diffusion structure 12 that diffuses the light reflected from the bottom output unit 10 of the LED holder 7 is formed in the top output unit 2*b*. Favorably the LED holder 7 is made of an opaque material such as a while material having a high reflectance in an entire visible wavelength range.

The operation indicating lamp 8 is held by the LED holder 7 such that an optical axis of the operation indicating lamp 8 is oriented toward a direction parallel to the top surface 2*a* of the case 2. As used herein, the term "optical axis" means an axis along the direction in which intensity of the light emitted from the light source (operation indicating lamp 8) becomes the maximum. The light is emitted from the operation indicating lamp 8 with the largest intensity in the direction along the optical axis. However, the light is emitted in not only the direction of the optical axis, but all directions. Accordingly, the light oriented toward the top surface 2*a* can exist even if the operation indicating lamp 8 is arranged in parallel to the top surface 2*a*.

The operation indicating lamp 8 is not necessarily arranged such that the optical axis of the operation indicating lamp 8 is oriented toward the direction parallel to the top surface 2*a* of the case 2. Even if the optical axis of the operation indicating lamp 8 is slightly deviated from the direction parallel to the top surface 2*a*, the operation indicating lamp 8 can be accommodated in a housing of the electromagnetic relay to contribute the compact electromagnetic relay when the operation indicating lamp 8 is arranged such that the optical axis direction is oriented toward the direction other than the display surface on the top surface of the case.

According to a situation of power supplied to the coil unit 3, the operation indicating lamp 8 outputs the light with the maximum intensity toward the bottom output unit 10 of the LED holder 7 in parallel to the top surface 2*a* of the case 2. The bottom output unit 10 has the opaque configuration, and regularly reflects the light, which is emitted from the operation indicating lamp 8 to propagate in air, toward the top output unit 2*b*.

The opaque configuration of the bottom output unit 10 may be made of a non-transparent material, or a reflection surface may be provided in at least a part of a transparent material to implement a non-transparent state. As used herein, the term "transparent" means a small absorption ratio of the light emitted from the light source (operation indicating lamp 8) in a material.

The diffusion structure 12 formed in the top output unit 2*b* diffuses the light reflected by the bottom output unit 10. The light shielding roof 7*c* shields the light that is output from the operation indicating lamp 8 toward the top surface 2*a* of the case 2.

Because the diffusion structure 12 is formed in the top output unit 2*b*, the uniformity and directionality of the light output from the top output unit 2*b* can further be improved. Therefore, the visibility is improved when the housing 2 of the relay 1 is observed from obliquely above. Particularly, the trouble of sequentially moving a head position along an array of the relays is eliminated because the lighting states of many relays attached to control panel can be checked from obliquely above.

The light shielding roof 7*c* shields the light that is output from the operation indicating lamp 8 toward the top surface 2*a*, so that only the square top output unit 2*b* that outputs the light reflected by the bottom output unit 10 can visually be recognized. When a white is selected as a color of the LED holder 7, the bottom output unit 10 can reflect any color light output from the operation indicating lamp 8.

(Configuration of Another Operation Indicator of First Embodiment)

Figure 6:
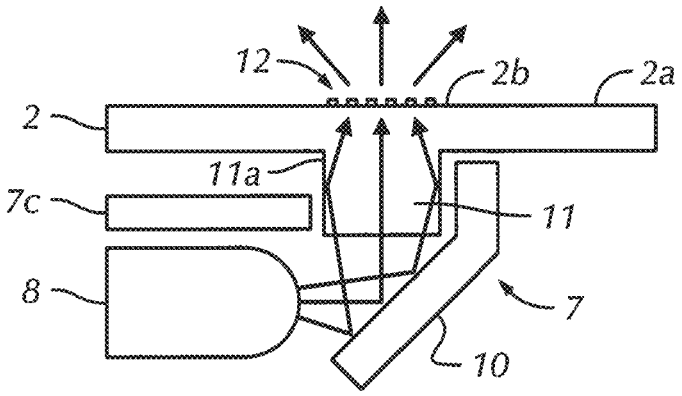
FIG. 6 is a schematic diagram illustrating a configuration of another operation indicator provided in the relay of the first embodiment.

FIG. 6 is a schematic diagram illustrating a configuration of another operation indicator provided in the relay 1. A component identical to the above component is designated by an identical reference numeral. The detailed overlapping description of the components is omitted. The same holds true for a component in the later-described drawings.

A light guide (light guide unit) 11 that guides the light output from the bottom output unit 10 to the top output unit 2*b* is formed below the top output unit 2*b* so as to project from the case 2 toward the bottom output unit 10. A side surface 11*a* is formed in the light guide 11. The side surface 11*a* totally reflects the light reflected by the bottom output unit 10, and guides the totally-reflected light to the top output unit 2*b*. A section of the light guide 11 is formed into a square shape corresponding to the square top output unit 2*b*.

The operation indicating lamp 8 emits the light toward the bottom output unit 10 of the LED holder 7 in parallel to the top surface 2*a* of the case 2 according to the situation of the power supplied to the coil unit 3. The bottom output unit 10 regularly reflects the light, which is emitted from the operation indicating lamp 8 to propagate in air, toward the light guide 11. The light regularly reflected by the bottom output unit 10 is incident on the light guide 11, totally reflected by the side surface 11*a* of the light guide 11, and guided to the top output unit 2*b*. The diffusion structure 12 formed in the top output unit 2*b* diffuses the light regularly reflected by the bottom output unit 10 and the light totally reflected by the side surface 11*a*.

Because the light guide 11 is added to the configuration in FIG. 5, the light regularly reflected by the bottom output unit 10 is totally reflected by the interface (side surface 11*a*) with an air layer of the light guide 11. Therefore, the light incident on the light guide 11 is uniformed, and the light is guided to the top output unit 2*b* while confined in the square section of the light guide 11. As a result, compared with the configuration in FIG. 5, the square edge of the top output unit 2*b* is clearly viewed when the housing 2 is viewed from obliquely above.

(Configuration of Still Another Operation Indicator of First Embodiment)

Figure 7:
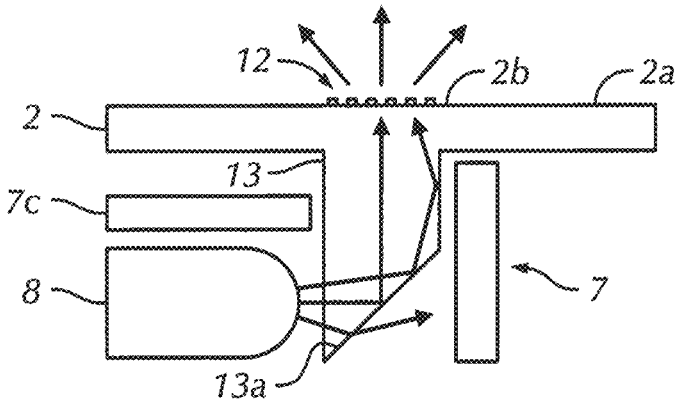
FIG. 7 is a schematic diagram illustrating a configuration of still another operation indicator provided in the relay of the first embodiment.

FIG. 7 is a schematic diagram illustrating a configuration of still another operation indicator provided in the relay 1. A component identical to the above component is designated by an identical reference numeral. The detailed overlapping description of the components is omitted. The same holds true for a component in the later-described drawings.

A total reflection light guide (a reflecting member and a light guide unit) 13 is formed below the top output unit 2*b* so as to project from the case 2 toward the inside of the case 2. A total reflection surface 13*a*, which totally reflects the light emitted from the operation indicating lamp 8 and guides the totally-reflected light to the top output unit 2*b*, is formed in the total reflection light guide 13. A section of the total reflection light guide 13 is formed into a square shape corresponding to the square top output unit 2*b*. The bottom output unit 10 in FIGS. 5 and 6 is not provided in the LED holder 7.

The operation indicating lamp 8 emits the light toward the total reflection light guide 13 in parallel to the top surface 2*a* of the case 2 according to the situation of the power supplied to the coil unit 3. The light emitted from the operation indicating lamp 8 is incident on the total reflection light guide 13, and totally reflected by the total reflection surface 13*a*. The light totally reflected by the total reflection surface 13*a* is partially guided to the top output unit 2*b*. The remaining totally-reflected light is totally reflected by the side surface of the total reflection light guide 13, and guided to the top output unit 2*b*. The diffusion structure 12 formed in the top output unit 2*b* diffuses the light guided to the top output unit 2*b*.

Because the total reflection light guide 13 is provided, the light totally reflected by the total reflection surface 13*a* of the total reflection light guide 13 is further totally reflected by the side surface (the interface with the air layer) of the total reflection light guide 13. Therefore, the light incident on the total reflection light guide 13 is uniformed, and the light is guided to the top output unit 2*b* while confined in the square section of the total reflection light guide 13. As a result, compared with the configuration in FIG. 5, the square edge of the top output unit 2*b* is clearly viewed when the housing 2 is viewed from obliquely above.

An interval in which the light is confined in the total reflection light guide 13 is longer than an interval in which the light is confined in the light guide 11 in FIG. 6. Therefore, light coupling efficiency is higher than that of the configuration in FIG. 5 without the light guide or the configuration in FIG. 6 with the light guide 11. Accordingly, luminance of the light output from the top output unit 2*b* is enhanced.

(Comparison Among Operation Indicators of First Embodiment)

The operation indicator in FIG. 5 and the operation indicator in FIG. 6 are higher in the uniformity and directionality of the light output from the top output unit 2*b* than the operation indicator in FIG. 7, in which the leakage light is generated in the total reflection surface 13*a*. In the operation indicator in FIG. 6, the light reflected by the bottom output unit 10 is reflected at the interface (side surface 11*a*) with the air layer by the light guide 11, and confined in the light guide 11. Therefore, the square edge of the top output unit 2*b* is clearly viewed because of the light guide in the air layer compared with the operation indicator in FIG. 5 in which the light expands until the light reaches the top output unit 2*b* since being reflected by the bottom output unit 10.

As illustrated in FIGS. 5 to 7, the uniformity and directionality of the light output from the top output unit 2*b* can be improved by forming the diffusion structure 12 in the top output unit 2*b*.

Second Embodiment (Configuration of Operation Indicator of Second Embodiment)

Figure 8:
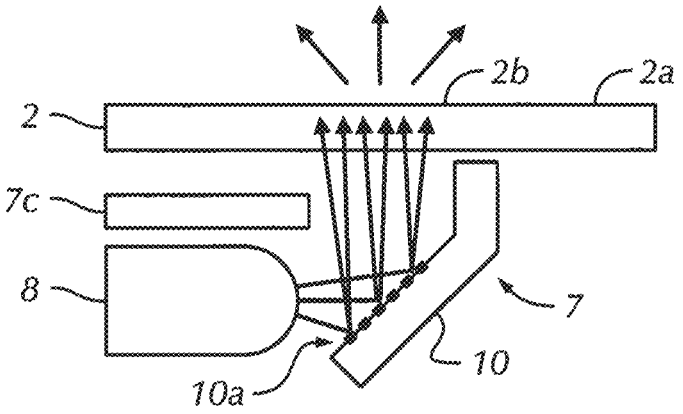
FIG. 8 is a schematic diagram illustrating a configuration of an operation indicator provided in a relay according to a second embodiment.

FIG. 8 is a schematic diagram illustrating a configuration of an operation indicator according to a second embodiment. A component identical to the above component is designated by an identical reference numeral. The detailed overlapping description of the components is omitted. The same holds true for a component in the later-described drawings.

A diffuse reflection structure 10*a* that diffusely reflects the light emitted from the operation indicating lamp 8 is formed in a surface facing the operation indicating lamp 8 of the bottom output unit 10. Compared with the operation indicator in FIG. 5, the diffusion structure 12 is not formed in the top output unit 2*b*, but the diffuse reflection structure 10*a* is added to the bottom output unit 10.

The operation indicating lamp 8 emits the light toward the bottom output unit 10 of the LED holder 7 in parallel to the top surface 2*a* of the case 2 according to the situation of the power supplied to the coil unit 3. The diffuse reflection structure 10*a* formed in the bottom output unit 10 diffusely reflects the light, which is emitted from the operation indicating lamp 8 to propagate in air, toward the top output unit 2*b*. The light diffusely reflected toward the top output unit 2*b* by the diffuse reflection structure 10*a* is output from the top output unit 2*b*.

The uniformity and directionality of the light, which is diffusely reflected by the diffuse reflection structure 10*a* and output from the top output unit 2*b*, can be improved because the diffuse reflection structure 10*a* is formed in the bottom output unit 10. Therefore, the visibility is improved when the housing 2 of the relay 1 is observed from obliquely above.

(Configuration of Another Operation Indicator of Second Embodiment)

Figure 9:
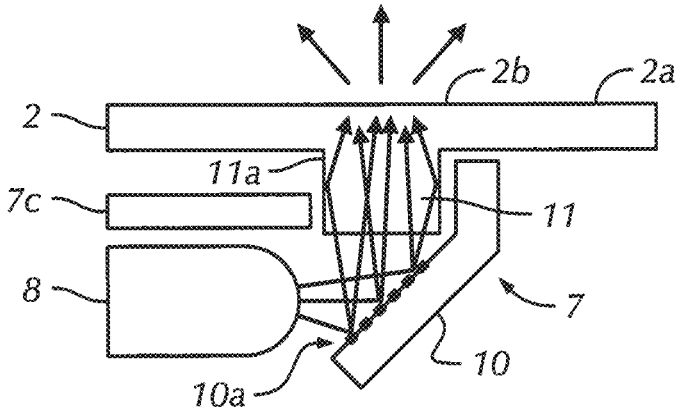
FIG. 9 is a schematic diagram illustrating a configuration of another operation indicator provided in the relay of the second embodiment.

FIG. 9 is a schematic diagram illustrating a configuration of another operation indicator of the second embodiment.

Similarly to the operation indicator in FIG. 8, the diffuse reflection structure 10*a* that diffusely reflects the light emitted from the operation indicating lamp 8 is formed in the surface facing the operation indicating lamp 8 of the bottom output unit 10. Compared with the operation indicator in FIG. 6, the diffusion structure 12 is not formed in the top output unit 2*b*, but the diffuse reflection structure 10*a* is added to the bottom output unit 10.

The operation indicating lamp 8 emits the light toward the diffuse reflection structure 10*a* of the LED holder 7 in parallel to the top surface 2*a* of the case 2 according to the situation of the power supplied to the coil unit 3. The diffuse reflection structure 10*a* diffusely reflects the light, which is emitted from the operation indicating lamp 8 to propagate in air, toward the light guide 11. The light diffusely reflected by the diffuse reflection structure 10*a* is incident on the light guide 11, totally reflected by the side surface 11*a* of the light guide 11, guided to the top output unit 2*b*, and output from the top output unit 2*b*.

The light, which is diffusely reflected by the diffuse reflection structure 10*a*, is guided by the light guide 11, and output from the top output unit 2*b*, because the diffuse reflection structure 10*a* is formed in the bottom output unit 10. Therefore, the uniformity and directionality of the light output from the top output unit 2*b* can be improved.

The light diffusely reflected by the diffuse reflection structure 10*a* is totally reflected by the interface (side surface 11*a*) with the air layer of the light guide 11. Therefore, the diffusely-reflected light incident on the light guide 11 is uniformed, and the diffusely-reflected light is guided to the top output unit 2*b* while confined in the square section of the light guide 11. As a result, compared with the configuration in FIG. 8, the square edge of the top output unit 2*b* is clearly viewed when the housing 2 is viewed from obliquely above.

(Configuration of Still Another Operation Indicator of Second Embodiment)

Figure 10:
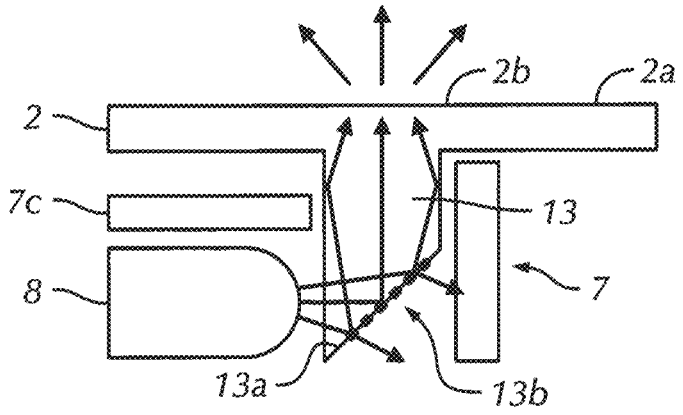
FIG. 10 is a schematic diagram illustrating a configuration of still another operation indicator provided in the relay of the second embodiment.

FIG. 10 is a schematic diagram illustrating a configuration of still another operation indicator of the second embodiment.

A diffuse reflection structure 13*b* that diffusely reflects the light emitted from the operation indicating lamp 8 is formed in a total reflection surface 13*a* of a total reflection light guide 13. Compared with the operation indicator in FIG. 7, the diffusion structure 12 is not formed in the top output unit 2*b*, but the diffuse reflection structure 13*b* is added to the total reflection surface 13*a* of the total reflection light guide 13.

The operation indicating lamp 8 emits the light toward the total reflection light guide 13 in parallel to the top surface 2*a* of the case 2 according to the situation of the power supplied to the coil unit 3. The light emitted from the operation indicating lamp 8 is incident on the total reflection light guide 13, and diffusely reflected by the diffuse reflection structure 13*b* formed in the total reflection surface 13*a*. The light diffusely reflected by the diffuse reflection structure 13*b* is partially guided to the top output unit 2*b*. The remaining diffusely-reflected light is totally reflected by the side surface of the total reflection light guide 13, and guided to the top output unit 2*b*. The light guided to the top output unit 2*b* is output from the top output unit 2*b*.

The uniformity and directionality of the light, which is diffusely reflected by the diffuse reflection structure 13*b* of the total reflection light guide 13 and output from the top output unit 2*b*, can be improved because the diffuse reflection structure 13*b* is formed in the total reflection light guide 13. Therefore, the visibility is improved when the housing 2 of the relay 1 is observed from obliquely above.

The light diffusely reflected by the diffuse reflection structure 13*b* is totally reflected by the interface (side surface) with the air layer of the total reflection light guide 13. Therefore, the light diffusely reflected by the diffuse reflection structure 13*b* is uniformed, and the diffusely-reflected light is guided to the top output unit 2*b* while confined in the square section of the total reflection light guide 13. As a result, compared with the configuration in FIG. 8, the square edge of the top output unit 2*b* is clearly viewed when the housing 2 is viewed from obliquely above.

(Comparison Among Operation Indicators of Second Embodiment)

The operation indicator in FIG. 8 and the operation indicator in FIG. 9 are higher in the uniformity and directionality of the light output from the top output unit 2*b* than the operation indicator in FIG. 10, in which the leakage light is generated in the diffuse reflection structure 13*b*. In the operation indicator in FIG. 9, the light diffusely reflected by the diffuse reflection structure 10*a* is reflected at the interface (side surface 11*a*) with the air layer by the light guide 11, and confined in the light guide 11. Therefore, the square edge of the top output unit 2*b* is clearly viewed because of the light guide in the air layer, compared with the operation indicator in FIG. 8 in which the light expands until the light reaches the top output unit 2*b* since being reflected by the diffuse reflection structure 10*a*.

The diffuse reflection structure 13*b* is not formed in the operation indicator in FIG. 7, but less leakage light is generated in the operation indicator in FIG. 7 compared with the operation indicator in FIG. 10. Therefore, the operation indicator in FIG. 7 has superiority over the operation indicator in FIG. 10 in the uniformity and directionality of the light output from the top output unit 2*b*.

As illustrated in FIGS. 8 to 10, the uniformity and directionality of the light output from the top output unit 2*b* can be improved by forming the diffuse reflection structures 10*a* and 13*b*.

Third Embodiment (Configuration of Operation Indicator of Third Embodiment)

Figure 11:
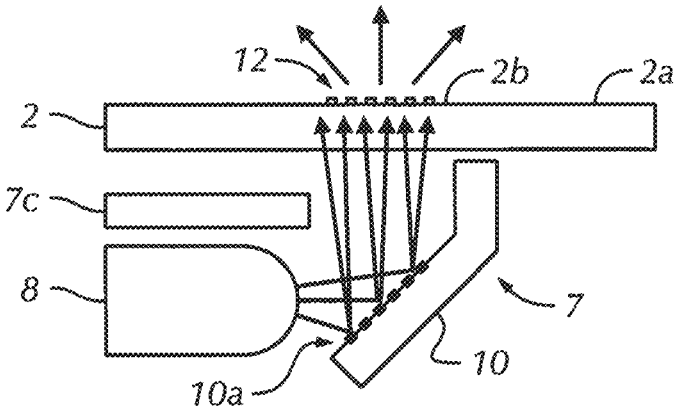
FIG. 11 is a schematic diagram illustrating a configuration of an operation indicator provided in a relay according to a third embodiment.

FIG. 11 is a schematic diagram illustrating a configuration of an operation indicator according to a third embodiment. A component identical to the above component is designated by an identical reference numeral. The detailed overlapping description of the components is omitted. The same holds true for a component in the later-described drawings.

Both the diffusion structure 12 of the top output unit 2*b* and the diffuse reflection structure 10*a* of the bottom output unit 10 are formed in an operation indicator according to a third embodiment in FIG. 11.

The operation indicating lamp 8 emits the light toward the bottom output unit 10 of the LED holder 7 in parallel to the top surface 2*a* of the case 2 according to the situation of the power supplied to the coil unit 3. The diffuse reflection structure 10*a* formed in the bottom output unit 10 diffusely reflects the light, which is emitted from the operation indicating lamp 8 to propagate in air, toward the top output unit 2*b*. The diffusion structure 12 of the top output unit 2*b* diffuses the light diffusely reflected by the diffuse reflection structure 10*a* of the bottom output unit 10.

The diffuse reflection structure 10*a* is formed in the bottom output unit 10 while the diffusion structure 12 is formed in the top output unit 2*b*, so that the uniformity and directionality of the light emitted from the top output unit 2*b* can further be improved compared with the operation indicators in FIGS. 5 and 8.

(Configuration of Another Operation Indicator of Third Embodiment)

Figure 12:
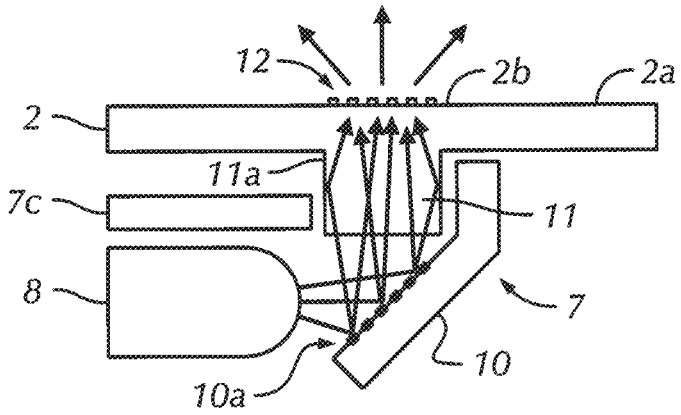
FIG. 12 is a schematic diagram illustrating a configuration of another operation indicator provided in the relay of the third embodiment.

FIG. 12 is a schematic diagram illustrating a configuration of another operation indicator of the third embodiment.

Both the diffusion structure 12 of the top output unit 2*b* and the diffuse reflection structure 10*a* of the bottom output unit 10 are formed in another operation indicator in FIG. 12.

The operation indicating lamp 8 emits the light toward the diffuse reflection structure 10*a* of the LED holder 7 in parallel to the top surface 2*a* of the case 2 according to the situation of the power supplied to the coil unit 3. The diffuse reflection structure 10*a* diffusely reflects the light, which is emitted from the operation indicating lamp 8 to propagate in air, toward the light guide 11. The light diffusely reflected by the diffuse reflection structure 10*a* is incident on the light guide 11, totally reflected by the side surface 11*a* of the light guide 11, and guided to the top output unit 2*b*. The diffusion structure 12 formed in the top output unit 2*b* diffusely outputs the light guided to the top output unit 2*b*.

The diffuse reflection structure 10*a* is formed in the bottom output unit 10 while the diffusion structure 12 is formed in the top output unit 2*b*, so that the uniformity and directionality of the light emitted from the top output unit 2*b* can further be improved compared with the operation indicators in FIGS. 6 and 9.

(Configuration of Still Another Operation Indicator of Third Embodiment)

Figure 13:
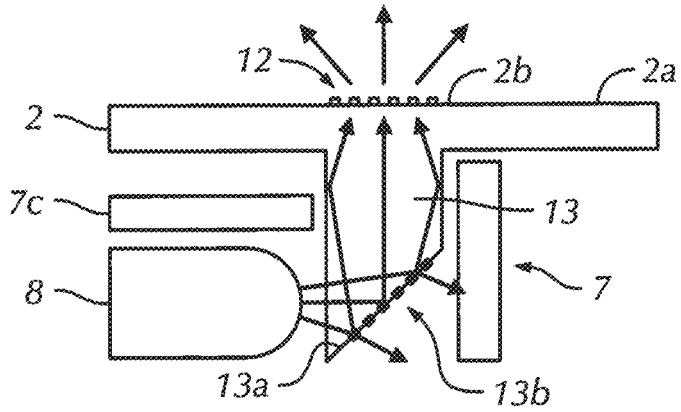
FIG. 13 is a schematic diagram illustrating a configuration of still another operation indicator provided in the relay of the third embodiment.

FIG. 13 is a schematic diagram illustrating a configuration of still another operation indicator of the third embodiment.

Both the diffusion structure 12 of the top output unit 2*b* and the diffuse reflection structure 13*b* of the total reflection light guide 13 are formed in still another operation indicator of the third embodiment in FIG. 13.

The operation indicating lamp 8 emits the light toward the total reflection light guide 13 in parallel to the top surface 2*a* of the case 2 according to the situation of the power supplied to the coil unit 3. The light emitted from the operation indicating lamp 8 is incident on the total reflection light guide 13, and diffusely reflected by the diffuse reflection structure 13*b* formed in the total reflection surface 13*a*. The light diffusely reflected by the diffuse reflection structure 13*b* is partially guided to the top output unit 2*b*. The remaining diffusely-reflected light is totally reflected by the side surface of the total reflection light guide 13, and guided to the top output unit 2*b*. The diffusion structure 12 formed in the top output unit 2*b* diffusely outputs the light guided to the top output unit 2*b*.

The diffuse reflection structure 13*b* is formed in the total reflection light guide 13 while the diffusion structure 12 is formed in the top output unit 2*b*, so that the uniformity and directionality of the light emitted from the top output unit 2*b* can further be improved compared with the operation indicators in FIGS. 7 and 10.

(Comparison Among Operation Indicators of Third Embodiment)

The operation indicator in FIG. 11 and the operation indicator in FIG. 12 are higher in the uniformity and directionality of the light output from the top output unit 2*b* than the operation indicator in FIG. 13, in which the leakage light is generated in the diffuse reflection structure 13*b*.

As illustrated in FIGS. 11 to 13, the uniformity and directionality of the light output from the top output unit 2*b* can be improved by forming both the diffuse reflection structure 10*a* and the diffusion structure 12 or both the diffuse reflection structure 13*b* and the diffusion structure 12.

Fourth Embodiment (Configuration of Operation Indicator of Fourth Embodiment)

Figure 14:
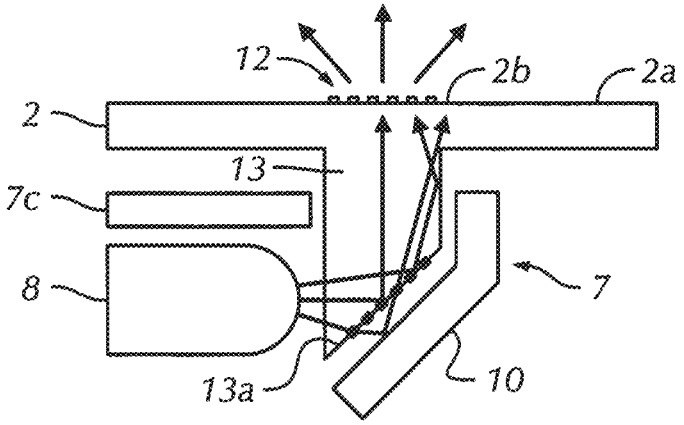
FIG. 14 is a schematic diagram illustrating a configuration of an operation indicator provided in a relay according to a fourth embodiment.

FIG. 14 is a schematic diagram illustrating a configuration of an operation indicator according to a fourth embodiment.

In the operation indicator of the fourth embodiment in FIG. 14, the bottom output unit 10 is provided in the LED holder 7 in addition to the configuration of the operation indicator in FIG. 7. The bottom output unit 10 reflects the light, which is emitted from the operation indicating lamp 8, incident on the total reflection light guide 13 and leaks from the total reflection surface 13*a* of the total reflection light guide 13, and returns the light to the total reflection light guide 13.

Therefore, a loss caused by the light leaking from the total reflection light guide 13 can be reduced to enhance the uniformity and directionality of the light output from the top output unit 2*b*.

(Uniformity and Directionality of Light Output from Operation Indicator in Relays of First to Fourth Embodiments)

Figure 15:
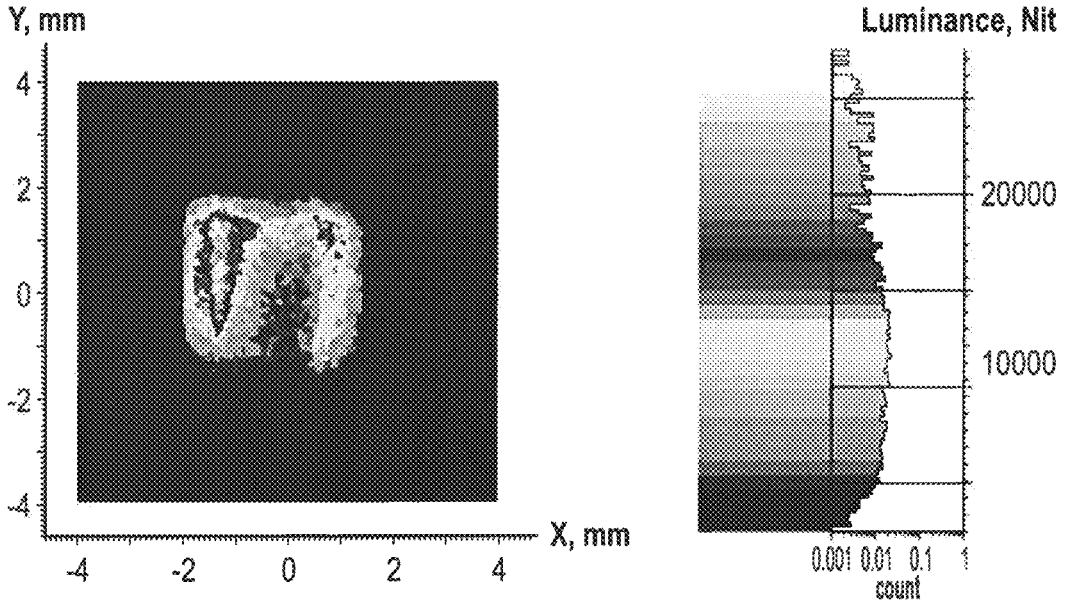
FIG. 15 is a view illustrating a spatial luminance distribution of light output from a top output unit according to a comparative example.

FIG. 15 is a view illustrating a spatial luminance distribution of light output from a top output unit according to a comparative example. FIG. 15 illustrates the spatial luminance distribution in the case that the diffuse reflection structure 10*a* is not formed in the bottom output unit 10 in FIG. 8, namely, in the case that neither the diffusion structure 12 nor the diffuse reflection structure 10*a* is formed. As can be seen from FIG. 15, unevenness exists in the spatial luminance distribution of the light output from the square region of the top output unit 2*b* arranged in the top surface 2*a* of the case 2.

Figure 16:
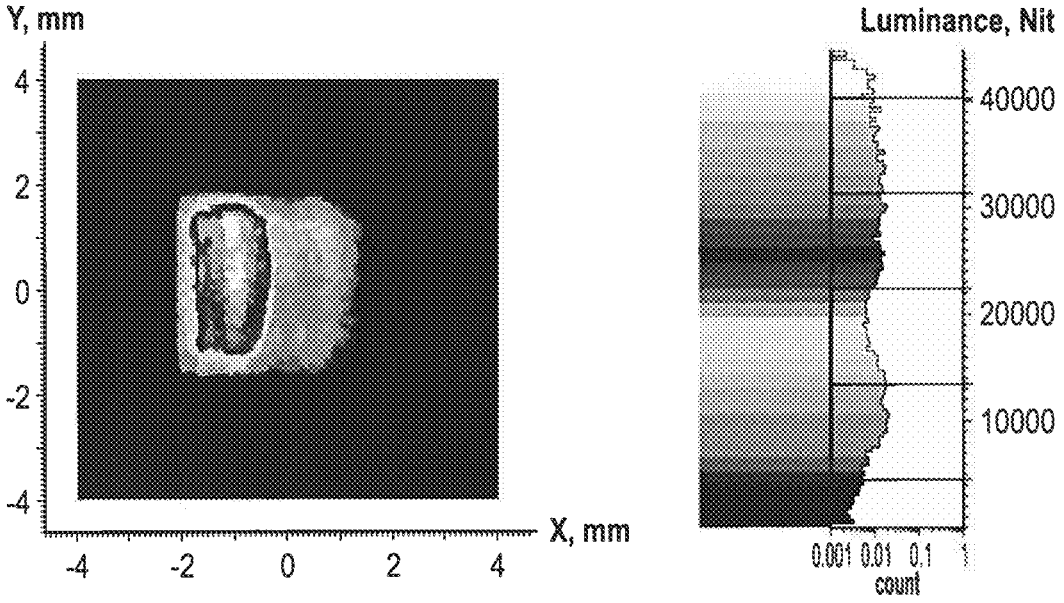
FIG. 16 is a view illustrating a spatial luminance distribution of the light output from the top output unit formed in the operation indicator of FIG. 6.

FIG. 16 is a view illustrating a spatial luminance distribution of the light output from the diffusion structure 12 of the top output unit 2*b* formed in the operation indicator of FIG. 6. As can be seen from FIG. 16, when the diffusion structure 12 is formed in the top output unit 2*b* arranged in the top surface 2*a* of the case 2, the uniformity of the spatial luminance distribution of the light output from the square region of the top output unit 2*b* is improved compared with the uniformity of the spatial luminance distribution in FIG. 15.

Figure 17:
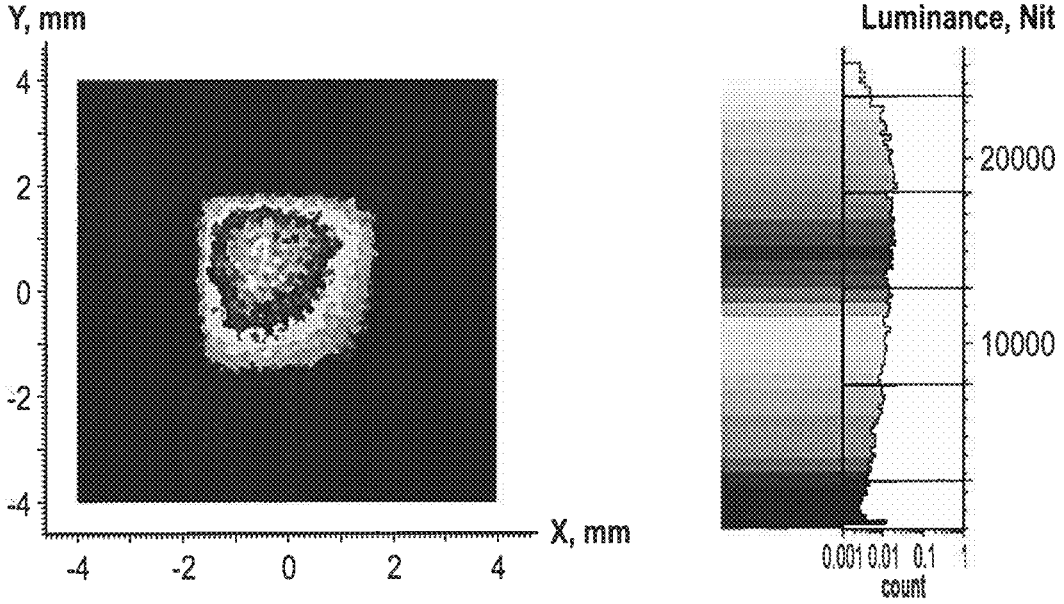
FIG. 17 is a view illustrating a spatial luminance distribution of the light output from the top output unit formed in the operation indicator of FIG. 9.

FIG. 17 is a view illustrating a spatial luminance distribution of the light output from the top output unit 2*b* formed in the operation indicator of FIG. 9. As can be seen from FIG. 17, when the diffuse reflection structure 10*a* is formed in the bottom output unit 10, the uniformity of the spatial luminance distribution of the light output from the square region of the top output unit 2*b* is improved compared with the uniformity of the spatial luminance distribution in FIG. 15.

Figure 18:
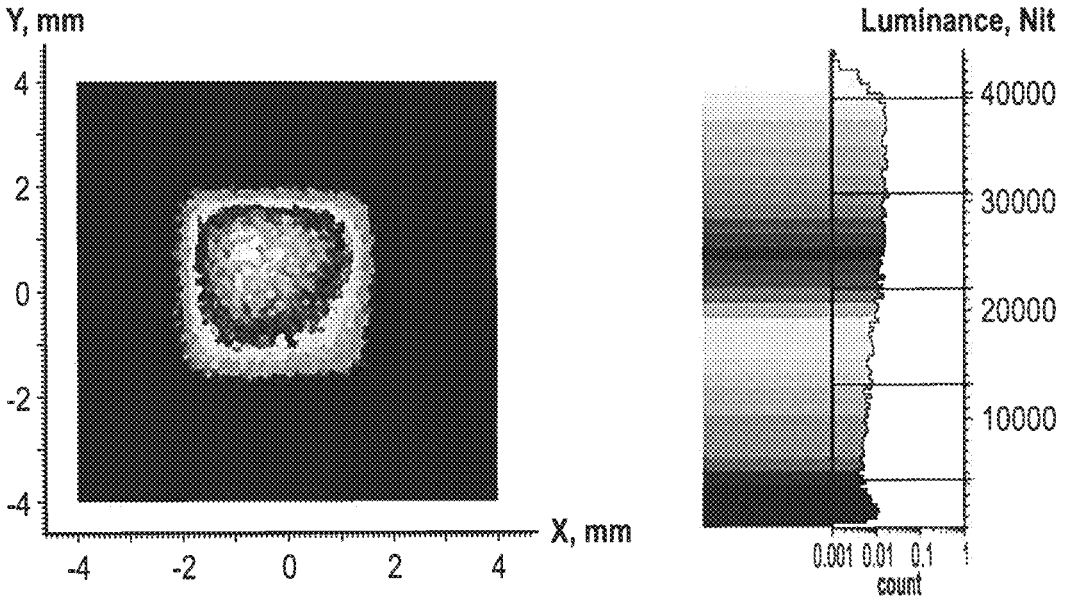
FIG. 18 is a view illustrating a spatial luminance distribution of the light output from the top output unit formed in the operation indicator of FIG. 12.

FIG. 18 is a view illustrating a spatial luminance distribution of the light output from the top output unit 2*b* formed in the operation indicator of FIG. 12. As can be seen from FIG. 18, when the diffuse reflection structure 10*a* is formed in addition to the diffusion structure 12, the uniformity of the spatial luminance distribution of the light output from the square region of the top output unit 2*b* is improved compared with the uniformity of the spatial luminance distributions in FIGS. 16 and 17.

Figure 19:
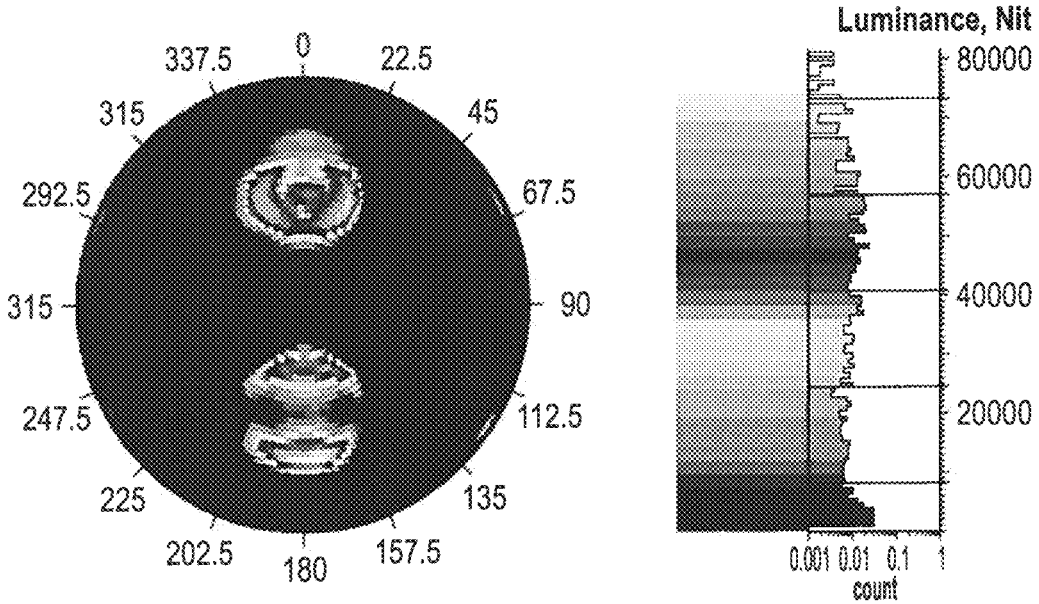
FIG. 19 is a view illustrating an angular luminance distribution of light output from a top output unit of the comparative example.

FIG. 19 is a view illustrating an angular luminance distribution of the light output from the top output unit of the comparative example. FIG. 19 illustrates the angular luminance distribution in the case that the diffuse reflection structure 10*a* is not formed in the bottom output unit 10 in FIG. 8, namely, in the case that neither the diffusion structure 12 nor the diffuse reflection structure 10*a* is formed. The numerical value described outside a circle on the left of FIG. 19 indicates an angular direction of the light that is output from the top output unit 2*b* when the top output unit 2*b* is viewed in the direction perpendicular to the top surface 2*a* of the case 2. In the angular luminance distribution in FIG. 19, a portion near the center does not glow, but plural luminance peaks exist, and the light output from the top output unit 2*b* has the narrow directionality.

Figure 20:
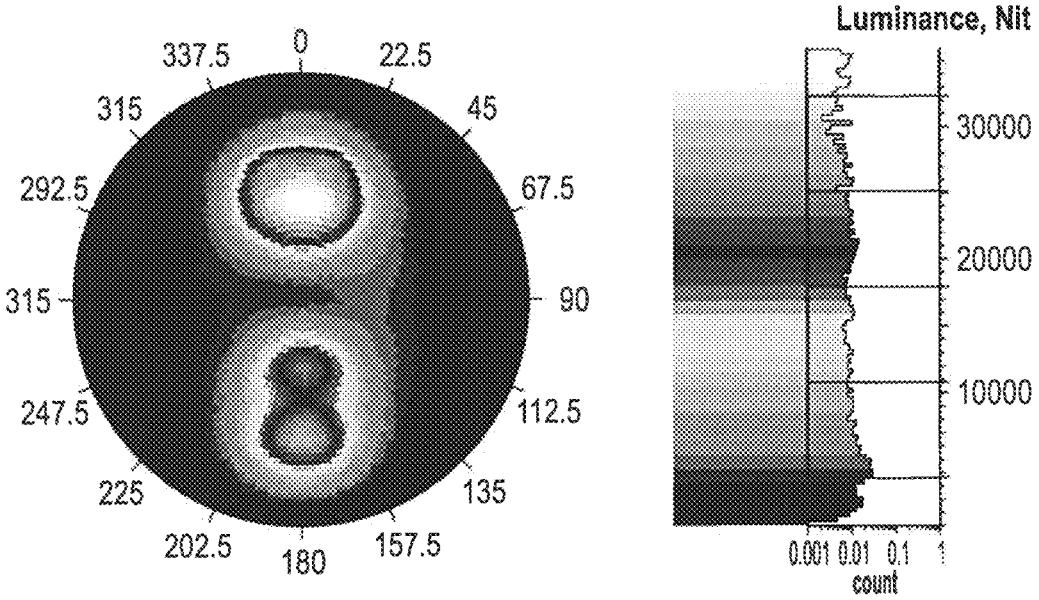
FIG. 20 is a view illustrating an angular luminance distribution of the light output from the top output unit formed in the operation indicator of FIG. 6.

FIG. 20 is a view illustrating an angular luminance distribution of the light output from the top output unit 2*b* formed in the operation indicator of FIG. 6. As can be seen from FIG. 20, when the diffusion structure 12 is formed in the top output unit 2*b*, the directionality of the light output from the top output unit 2*b* is widened and improved.

Figure 21:
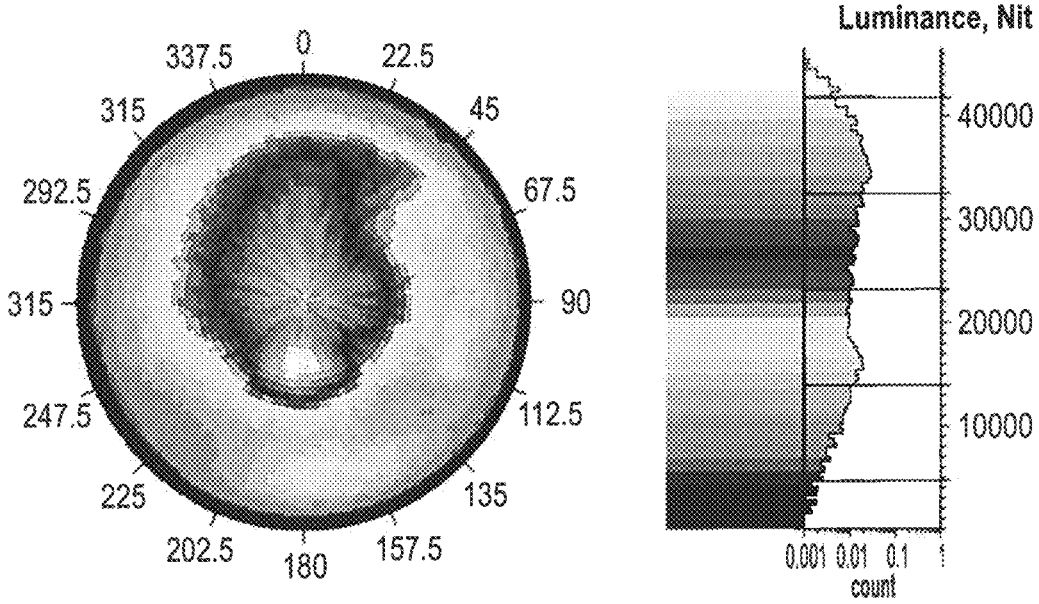
FIG. 21 is a view illustrating an angular luminance distribution of the light output from the top output unit formed in the operation indicator of FIG. 9.

FIG. 21 is a view illustrating an angular luminance distribution of the light output from the top output unit 2*b* formed in the operation indicator of FIG. 9. As can be seen from FIG. 21, when the diffuse reflection structure 10*a* is formed in the bottom output unit 10, the directionality of the light output from the top output unit 2*b* is widened and improved.

Figure 22:
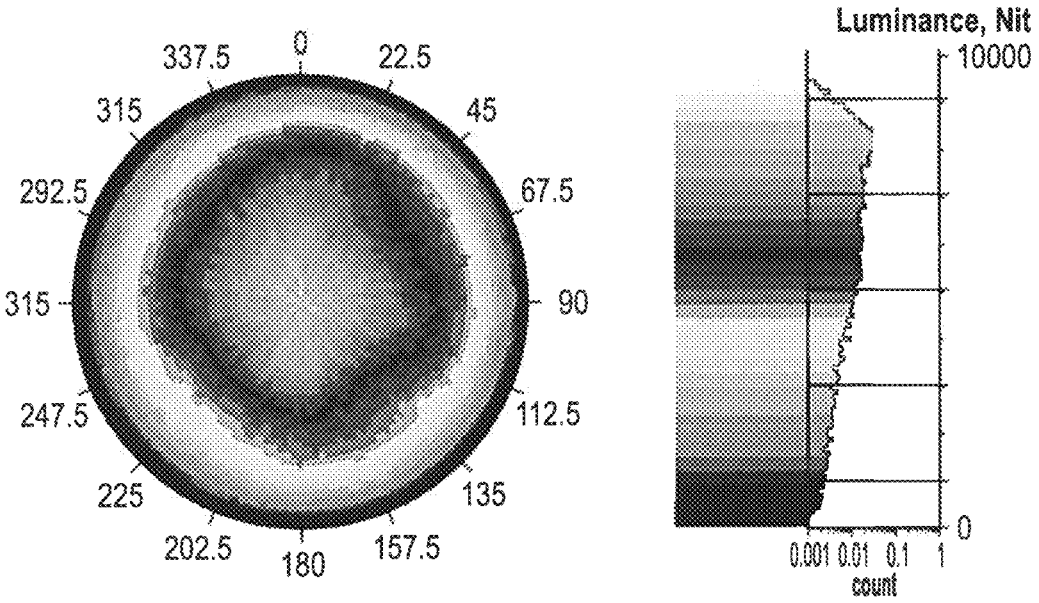
FIG. 22 is a view illustrating an angular luminance distribution of the light output from the top output unit formed in the operation indicator of FIG. 12.

FIG. 22 is a view illustrating an angular luminance distribution of the light output from the top output unit 2*b* formed in the operation indicator of FIG. 12. As can be seen from FIG. 22, when the diffuse reflection structure 10*a* is formed in addition to the diffusion structure 12, the plural luminance peaks are reduced to the single luminance peak, the directionality of the light output from the top output unit 2*b* is sufficiently widened and further improved compared with the directionality of the light in FIGS. 20 and 21.

(Reflectance of LED Holder 7)

Figure 23:
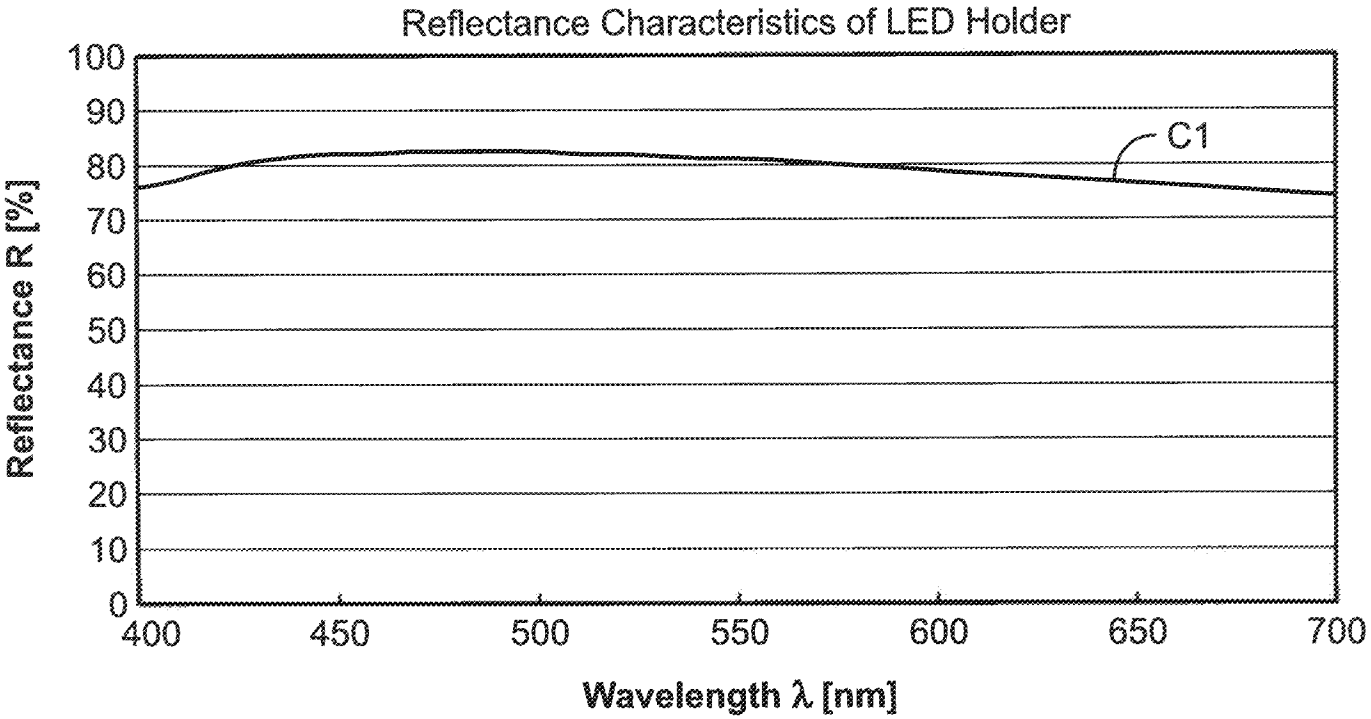
FIG. 23 is a graph illustrating a reflectance of the LED holder.

FIG. 23 is a graph illustrating reflectance characteristics of the LED holder 7. A horizontal axis indicates a wavelength of the light reflected by the LED holder 7. A vertical axis indicates a reflectance of the light reflected by the LED holder 7. When the LED holder 7 is made of a white material, as indicated by a curve C1, the LED holder 7 has the reflectance of at least 70% in the wavelength band of 400 nm to 700 nm expressing the entire wavelength range of visible light. According to one or more embodiments of the present invention, the LED holder 7 is made of the white material because the LED holder 7 reflects the light corresponding to the entire wavelength range of visible light.

(Diffuse Reflection in Inner Wall 7*a* of LED Holder 7)

Figure 24:
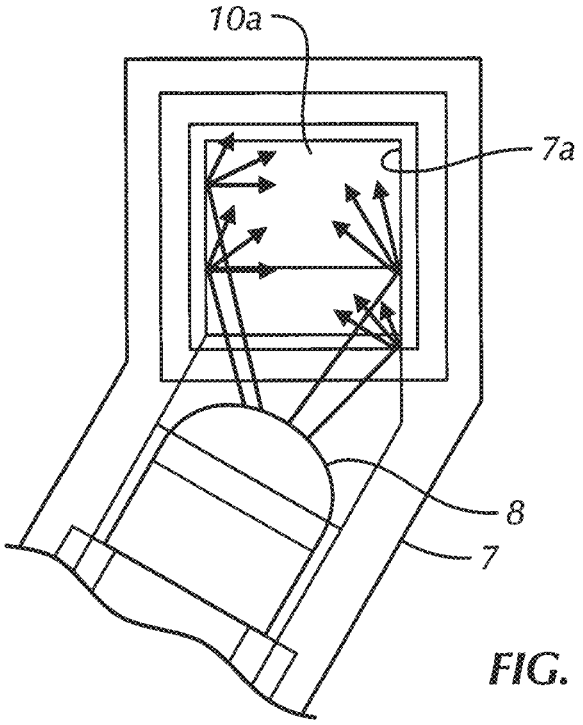
FIG. 24 is a view illustrating diffuse reflection in an inner wall of the LED holder in the operation indicators of the first to fourth embodiments.

FIG. 24 is a view illustrating diffuse reflection in an inner wall 7*a* of the LED holder 7 in the operation indicators of the first to fourth embodiments. The directionality of the light output from the top output unit 2*b* is improved by not only the diffuse reflection of the diffuse reflection structures 10*a* and 13*b* in FIGS. 8 to 13 but also by the diffuse reflection of the light emitted from the operation indicating lamp 8, of the inner wall 7*a* formed in the LED holder 7. When the diffuse reflection is generated, the light emitted from the operation indicating lamp 8 travels in various angular direction after striking on the inner wall 7*a* of the LED holder 7. The light beams traveling in various angular directions mix one another to improve the directionality of the light output from the top output unit 2*b*.

(Reflection by Bottom Output Unit 10 and Leakage Light Caused by Total Reflection Light Guide 13)

Figure 25:
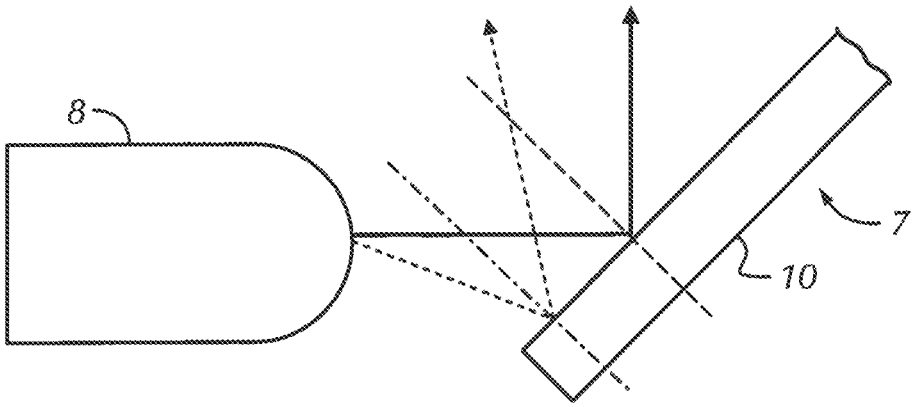
FIG. 25 is a view illustrating a reflection system of a bottom output unit provided in the LED holder.

FIG. 25 is a view illustrating a reflection system of the bottom output unit 10 provided in the LED holder 7. Because the diffuse reflection structure 10*a* is not formed in the bottom output unit 10 of the first embodiment in FIGS. 5 to 7, the light output from the operation indicating lamp 8 is regularly reflected by the surface of the bottom output unit 10 in the case of the white LED holder 7. The light, which is emitted from the operation indicating lamp 8 and incident on the surface of the bottom output unit 10, is reflected in the fixed angular direction in which the incident angle is equal to the reflection angle.

Figure 26:
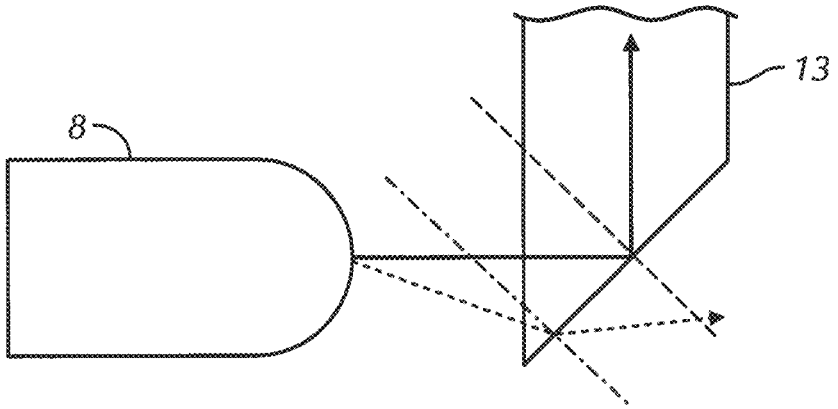
FIG. 26 is a view illustrating the reflection system of a total reflection light guide in the operation indicators of the first to fourth embodiments.

FIG. 26 is a view illustrating the reflection system of the total reflection light guide 13 in the operation indicators of the first to fourth embodiments. The operation indicating lamp 8 emits the light toward the total reflection light guide 13. The light emitted from the operation indicating lamp 8 is incident on the total reflection light guide 13, and totally reflected by the total reflection surface 13*a*.

However, when an output angle of the light from the operation indicating lamp 8 increases, the light incident on the total reflection light guide 13 from the operation indicating lamp 8 is not totally reflected by total reflection surface 13*a* but refracted, and the light leaks from the total reflection surface of the total reflection light guide 13 as the leakage light.

(Principle Generating Leakage Light of Total Reflection Light Guide 13)

Figure 27:
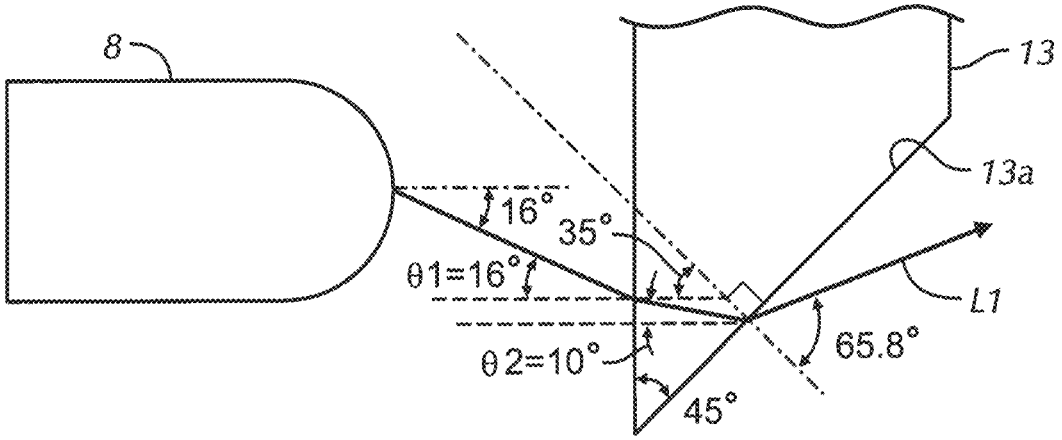
FIG. 27 is a schematic diagram illustrating a principle generating leakage light of the total reflection light guide.

FIG. 27 is a schematic diagram illustrating a principle generating the leakage light of the total reflection light guide 13. In the total reflection light guide 13, leakage light L1 that is not totally reflected but refracted by the total reflection surface 13*a* is generated when the light is incident at an incident angle of a given angle or more.

As to a generation condition of the leakage light L1 refracted by the total reflection surface 13*a*, the incident angle (critical angle θc) is less than 39 degrees with respect to the total reflection surface 13*a*.

The condition that the light guided in polycarbonate constituting the total reflection light guide 13 is refracted by the total reflection surface 13*a* is considered.

Assuming that θc is a critical angle and that n is a refractive index, θc of 39 degrees is obtained from sin(θc) =(1/n) and the polycarbonate having refractive index n=1.59.

Therefore, the light is refracted by the total reflection surface 13*a* when being incident on the total reflection surface 13*a* at the incident angle less than 39 degrees.

At this point, an incident angle θ1 of the light from the operation indicating lamp 8 on the total reflection light guide 13 becomes 9.5 degrees or more.

An incident angle condition that the light is refracted by the total reflection surface 13*a* is obtained. When the light emitted from the operation indicating lamp 8 is incident on the total reflection light guide 13, a behavior of the light is expressed by a law of refraction.

$$n1\times\sin(\theta1)=n2\times\sin(\theta2),$$

refractive index of air: n1=1, refractive index of polycarbonate: n2=1.59, because θ2=6 degrees is obtained for incident angle of 39 degrees with respect to the total reflection surface 13*a*, $$1\times\sin(\theta1)=1.59\times0.1,$$

therefore, θ1≈9.5 degrees is obtained.

For example, as illustrated in FIG. 27, when the light having incident angle θ1=16 degrees is incident on the total reflection light guide 13, the light is refracted at θ2=10 degrees, and the light is refracted by the total reflection surface 13*a* of the total reflection light guide 13 at the output angle of 65.8 degrees.

(Loss of Light Incident from Operation Indicating Lamp 8 at Total Reflection Surface 13*a*)

Figure 28A:
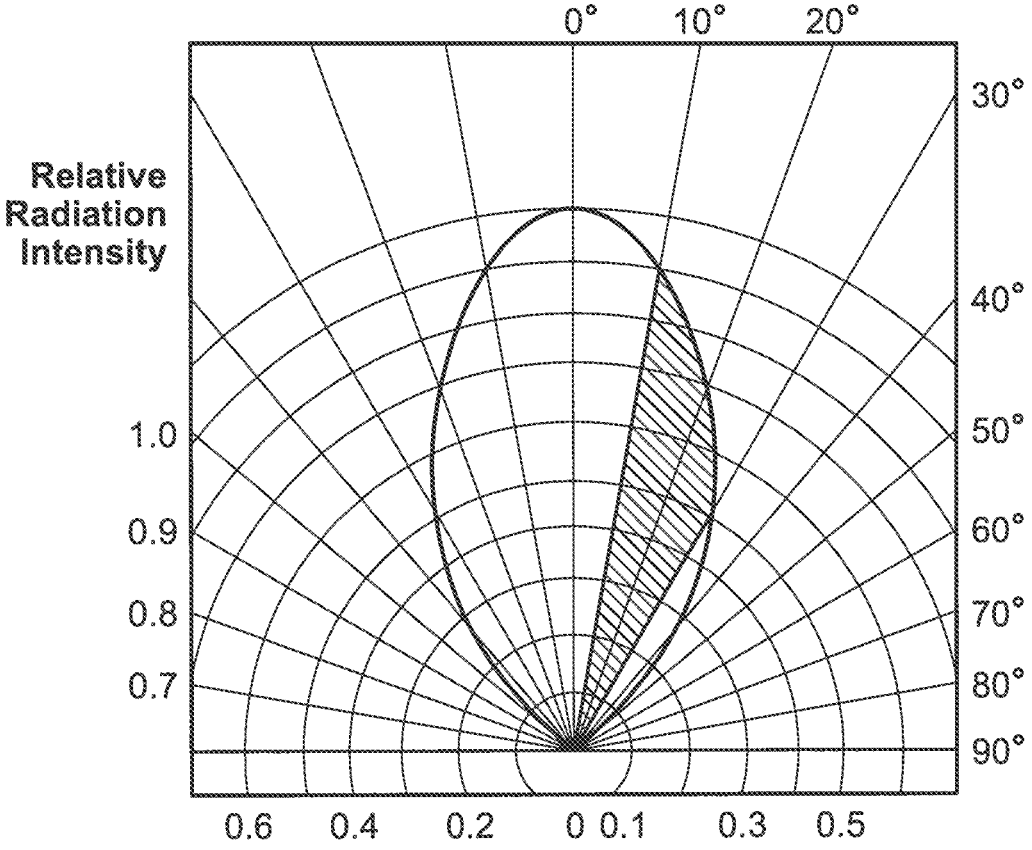
FIG. 28A is a graph illustrating a directional distribution of an operation indicating lamp provided in the operation indicators of the first to fourth embodiments.
Figure 28B:
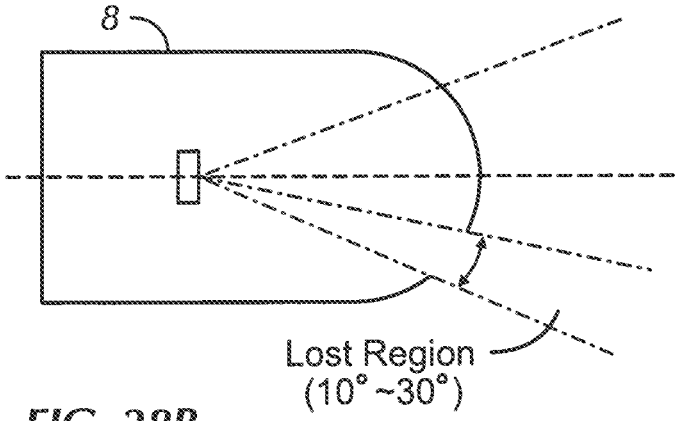
FIG. 28B is a view illustrating the light, which is incident on the total reflection light guide and lost in a total reflection surface.

FIG. 28A is a graph illustrating a directional distribution of the operation indicating lamp 8 provided in the operation indicators of the first to fourth embodiments, and a 0-degree direction in which the intensity becomes the maximum is the optical axis direction. FIG. 28B is a view illustrating the light, which is incident on the total reflection light guide 13 and lost in the total reflection surface 13*a*. As described above with reference to FIG. 27, the light from the operation indicating lamp 8 at the incident angle θ1 of 9.5 degrees or more with respect to the total reflection light guide 13 is refracted and lost by the total reflection surface 13*a* of the total reflection light guide 13. That is, the light that is output in the direction inclined at angles of 10 degrees to 30 degrees with respect to the optical axis of the operation indicating lamp 8 is refracted and lost by the total reflection surface 13*a*. The light that is output in the direction inclined at angles of 10 degrees to 30 degrees corresponds to about 20% of the light emitted from the operation indicating lamp 8.

(Diffuse Reflection)

Figure 29A:
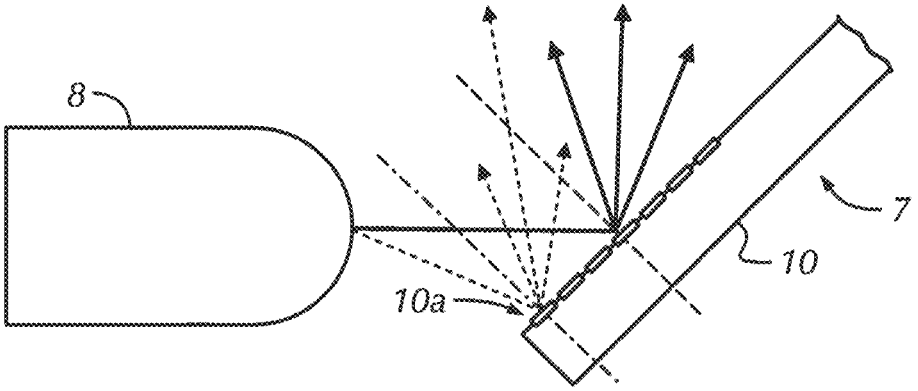
FIG. 29A is a view illustrating the diffuse reflection of the bottom output unit.
Figure 29B:
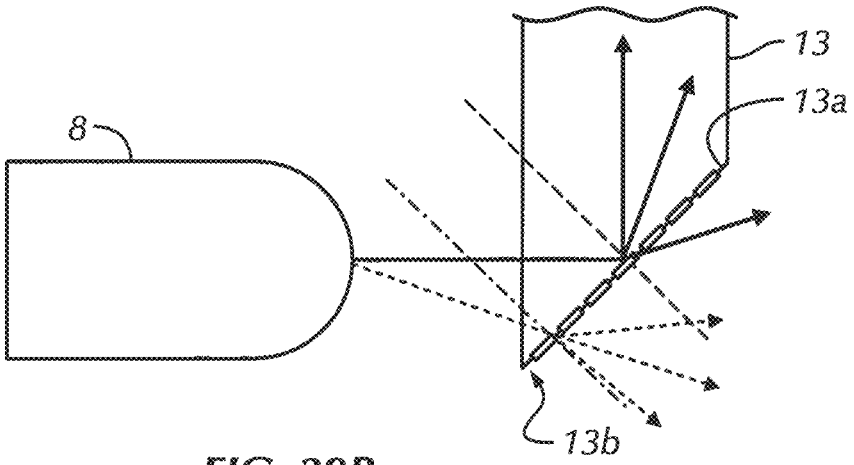
FIG. 29B is a view illustrating the diffuse reflection of the total reflection light guide.

FIG. 29A is a view illustrating the diffuse reflection of the bottom output unit 10, and FIG. 29B is a view illustrating the diffuse reflection of the total reflection light guide 13.

When the light emitted from the operation indicating lamp 8 is diffusely reflected toward the top output unit 2*b* by the diffuse reflection structure 10*a* of the bottom output unit 10, the uniformity and directionality of the light output from the top output unit 2*b* are improved because the light travels in various directions from the diffuse reflection structure 10*a*.

When the diffuse reflection structure 13*b* is formed in the total reflection surface 13*a* of the total reflection light guide 13 to diffusely reflect the light from the operation indicating lamp 8 toward the top output unit 2*b*, the uniformity and directionality of the light output from the top output unit 2*b* are improved because the light travels in various directions from the diffuse reflection structure 13*b*. However, as described above with reference to FIG. 27, the light having the large incident angle θ1 with respect to the total reflection light guide 13 leaks from the total reflection surface 13*a*. That is, the light does not leak in the configuration in FIG. 29A, but the light leaks in the configuration in FIG. 29B.

(Definitions of Diffusion Structure 12 and Diffuse Reflection Structures 10*a* and 13*b*)

FIG. 30 is a view illustrating a relationship among surface roughness of a diffusion structure, a haze value, and visual quality in the diffusion structure 12 and the diffuse reflection structures 10*a* and 13*b* of the operation indicators of the first to fourth embodiments.

The diffusion structure 12 is a rough surface (texturing surface) in which fine irregularities are randomly formed on the surface of the top output unit 2*b* of the case 2. In the rough surface, desirably surface roughness is less than or equal to 67 μm, and haze value is greater than or equal to 44.7%. FIG. 30 illustrates an evaluation result of visual quality of each sample when surface roughness is changed in a range of 4 μm to 67 μm and when the haze value is changed in a range of 15% to 88%. At this point, "○" of the visual quality means that the surface roughness of the diffusion structure 12 is inconspicuous, and that the light output from the top output unit 2*b* has a sufficiently wide directional angle (that is, the output light can be recognized in the direction inclined at 30 degrees or more with respect to the direction perpendicular to the relay top surface in any direction around the direction perpendicular to the relay top surface). On the other hand, "x" of the visual quality means that the surface roughness of the diffusion structure 12 is not suitable for product, or that the output light can hardly be recognized in the direction inclined at 30 degrees or more with respect to the direction perpendicular to the relay top surface in any direction around the direction perpendicular to the relay top surface.

As can be seen from FIG. 30, the top output unit 2*b* has the good visual quality when the diffusion structure 12 of the top output unit 2*b* has the surface roughness of 4 μm to 30 μm, and when the haze value ranges from 48% to 87%.

In the diffuse reflection structures 10*a* and 13*b*, similarly to the diffusion structure 12, the surface roughness ranges from 4 μm to 30 μm, and the haze value ranges from 48% to 87%.

(Measure Against Soot Fouling)

Figure 31A:
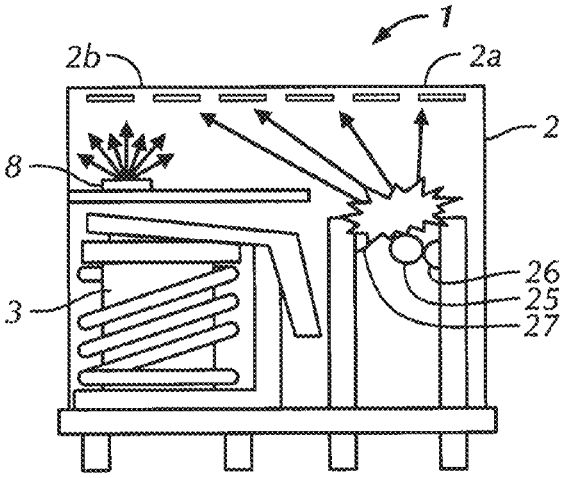
FIG. 31A is a schematic diagram illustrating soot fouling in a case of the relay of the comparative example.
Figure 31B:
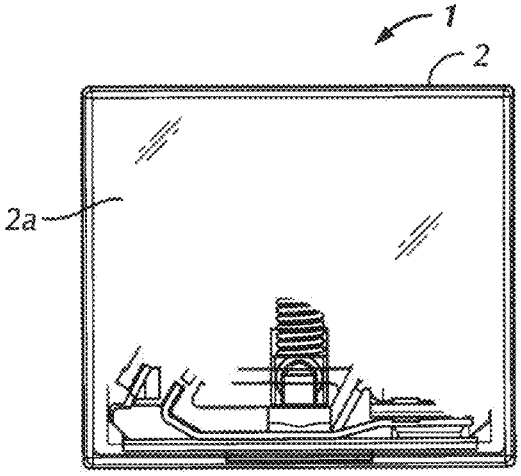
FIG. 31B is an image illustrating the soot fouling.

FIG. 31A is a schematic diagram illustrating soot fouling in the case of the relay of the comparative example, and FIG. 31B is an image illustrating the soot fouling. The case 2 is burnt to generate vapor and soot due to an arc that is generated between the movable contact 25 and the normally closed contact 26 and between the movable contact 25 and the normally opened contact 27. When the relay is used for a long time, the visibility of the lighting state of the operation indicating lamp 8 degrades because the top surface 2*a* of the case 2 is stained by the vapor and soot.

Figure 32A:
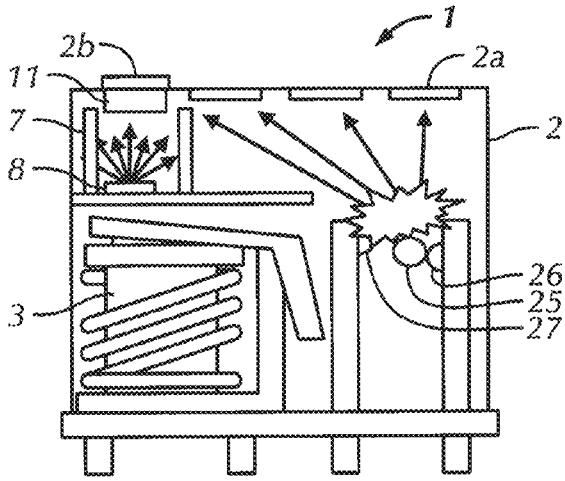
FIG. 32A is a schematic diagram illustrating the soot fouling in the case of the relays of the first to fourth embodiments.
Figure 32B:
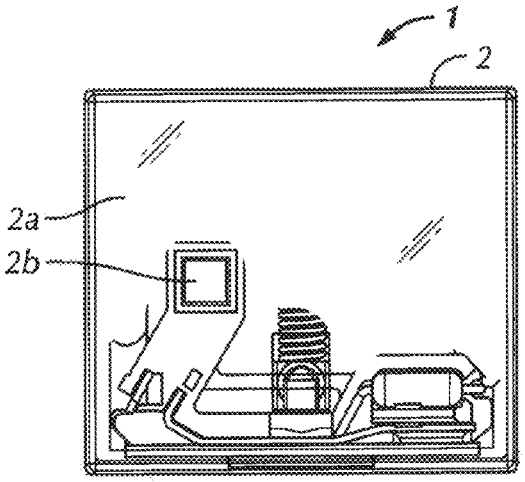
FIG. 32B is an image illustrating the soot fouling.

FIG. 32A is a schematic diagram illustrating the soot fouling in the case 2 of the relays 1 of the first to fourth embodiments, and FIG. 32B is an image illustrating the soot fouling. The operation indicating lamp 8 is held in the recess of the LED holder 7, and the light guide 11 and the total reflection light guide 13 are formed so as to project from the case 2 toward the inside of the LED holder 7. Therefore, the vapor and soot caused by the arc can invade into the LED holder 7 only through a gap between the LED holder 7 and the light guide 11 or a gap between the LED holder 7 and the total reflection light guide 13 to restrict adhesion of the vapor and soot to a place corresponding to the top output unit 2*b*. Therefore, even if the relay is used for a long time, the visibility of the light output from the top output unit 2*b* is not impaired, and operation display performance does not degrade.

The present invention is not limited to the above embodiments, and various changes can be made without departing from the scope of the present invention. It is noted that embodiments obtained by a combination of different embodiments is also included in the scope of the present invention.

One or more embodiments of the present invention may be applied to the relay. One or more embodiments of the present invention may be applied to the relay having the function of displaying the light emitting operation.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

The invention claimed is:

1. An operation indicating lamp-equipped electromagnetic relay, comprising:

an excitation coil;

a contact member that has electromagnetic interaction with the excitation coil to open and close a circuit;

a housing in which the excitation coil and the contact member are disposed, and having a display surface arranged in a top surface thereof;

a light source comprising an optical axis that is oriented toward a direction other than the display surface in order to display an operating situation of the electromagnetic relay, and being disposed in the housing so as to emit light according to a situation of power supplied to the excitation coil;

a reflecting member disposed in the housing so as to reflect the light emitted from the light source toward the display surface; and a diffusion structure that diffuses the light reflected by the reflecting member formed in the display surface.

2. The operation indicating lamp-equipped electromagnetic relay according to claim 1, wherein the reflecting member reflects the light emitted from the light source to propagate in air.

3. The operation indicating lamp-equipped electromagnetic relay according to claim 1, further comprising:

a light guide unit that guides the light reflected by the reflecting member to the display surface, wherein the reflecting member reflects the light emitted from the light source to propagate in air, and wherein the light guide unit comprises a side surface that totally reflects the reflected light to guide the totally-reflected light to the display surface.

4. The operation indicating lamp-equipped electromagnetic relay according to claim 1, further comprising:

a light guide unit that guides the light reflected by the reflecting member to the display surface, wherein the reflecting member is integrated with the light guide unit, and wherein the reflecting member comprises a total reflection surface arranged so as to totally reflect the light emitted from the light source to guide the totally-reflected light to the display surface.

5. The operation indicating lamp-equipped electromagnetic relay according to claim 1, wherein the reflecting member reflects the light emitted from the light source to propagate in air, and wherein a diffuse reflection structure that diffusely reflects the light is formed in the reflecting member, the light being emitted from the light source to propagate in air.

6. The operation indicating lamp-equipped electromagnetic relay according to claim 1, further comprising:

a light guide unit that guides the light reflected by the reflecting member to the display surface; and a diffuse reflection structure that diffusely reflect the light formed in the reflecting member, the light being emitted from the light source to propagate in air.

7. The operation indicating lamp-equipped electromagnetic relay according to claim 1, further comprising:

a light guide unit that guides the light reflected by the reflecting member to the display surface; and a diffuse reflection structure that diffusely reflects the light formed in the reflecting member, the light being emitted from the light source to propagate in air, wherein the reflecting member is integrated with the light guide unit, wherein the reflecting member comprises a total reflection surface arranged so as to totally reflect the light emitted from the light source to guide the totally-reflected light to the display surface, and wherein the diffuse reflection structure is formed in the total reflection surface.

8. The operation indicating lamp-equipped electromagnetic relay according to claim 1, further comprising:

a holder accommodated in the housing so as to hold a light emitting diode and the reflecting member, wherein the light source is the light emitting diode, wherein the holder holds the light emitting diode such that an optical axis of the light emitting diode is oriented toward the direction other than the display surface, and wherein the holder is formed so as to cover a top surface side of the light emitting diode.

9. An operation indicating lamp-equipped electromagnetic relay, comprising:

an excitation coil;

a contact member that has electromagnetic interaction with the excitation coil to open and close a circuit;

a housing in which the excitation coil and the contact member are disposed, and having a display surface arranged in a top surface thereof;

a light source comprising an optical axis that is oriented toward a direction other than the display surface in order to display an operating situation of the electromagnetic relay, the light source being disposed in the housing so as to emit light according to a situation of power supplied to the excitation coil; and a reflecting member disposed in the housing so as to reflect the light emitted from the light source toward the display surface, wherein a diffuse reflection structure that diffusely reflects the light emitted from the light source is formed in the reflecting member.

10. The operation indicating lamp-equipped electromagnetic relay according to claim 9, wherein the diffuse reflection structure diffusely reflects the light emitted from the light source to propagate in air, to guide the diffusely-reflected light to the display surface.

11. The operation indicating lamp-equipped electromagnetic relay according to claim 9, further comprising:

a light guide unit that guides the light diffusely reflected by the diffuse reflection structure to the display surface, wherein the light guide unit comprises a side surface that totally reflects the diffusely-reflected light to guide the totally-reflected light to the display surface.

12. The operation indicating lamp-equipped electromagnetic relay according to claim 9, further comprising:

a light guide unit that guides the light diffusely reflected by the diffuse reflection structure to the display surface, wherein the reflecting member is integrated with the light guide unit, wherein the reflecting member comprises a total reflection surface arranged so as to totally reflect the light emitted from the light source to guide the totally-reflected light to the display surface, and wherein the diffuse reflection structure is formed in the total reflection surface.

* * * * *